United States Patent [19]

Asai et al.

[11] 4,106,459

[45] Aug. 15, 1978

[54] ULTRASONIC WAVE CARBURETOR

[75] Inventors: Kiyokazu Asai; Akihiro Takeuchi, both of Nagoya, Japan

[73] Assignee: Kabushiki Kaisha Toyota Chuo Kenkyusho, Japan

[21] Appl. No.: 692,349

[22] Filed: Jun. 3, 1976

[30] Foreign Application Priority Data

Jun. 3, 1975 [JP] Japan ..... 50-67298

[51] Int. Cl.[2] ..... F02M 27/08

[52] U.S. Cl. ..... 123/141; 123/119 EE; 261/81; 261/DIG. 48

[58] Field of Search ..... 123/119 E, 119 EE, 141, 123/198 E, 32 AB; 261/81, DIG. 48

[56] References Cited

U.S. PATENT DOCUMENTS

| | | | |
|---|---|---|---|
| 2,453,595 | 11/1948 | Rosenthal | 123/119 EE X |
| 2,576,450 | 11/1951 | Marval | 123/119 E |
| 2,791,994 | 5/1957 | Grieb | 123/119 EE |
| 2,907,648 | 10/1959 | Chapman | 261/DIG. 48 |
| 2,949,900 | 8/1960 | Bodine | 123/119 EE |
| 3,284,762 | 11/1966 | Kompanek | 261/DIG. 48 |
| 3,349,354 | 10/1967 | Miyata | 123/119 E |
| 3,804,329 | 4/1974 | Maitner | 261/DIG. 48 |
| 3,805,492 | 4/1974 | King | 123/119 E X |
| 4,038,348 | 7/1977 | Kompanek | 261/DIG. 48 |

FOREIGN PATENT DOCUMENTS

| | | | |
|---|---|---|---|
| 2,318,779 | 1972 | Fed. Rep. of Germany | 261/DIG. 48 |

*Primary Examiner*—Charles J. Myhre
*Assistant Examiner*—Ira S. Lazarus
*Attorney, Agent, or Firm*—Oblon, Fisher, Spivak, McClelland & Maier

[57] ABSTRACT

An ultrasonic wave carburetor includes an intake passage for admitting fresh air and supplying an air-fuel mixture therethrough, and a fuel supply device including a fuel reservoir, a venturi, and a nozzle one end of which is open into the venturi and the other end of which is communicated with the fuel reservoir. A fuel atomizing device, including an ultrasonic transducer connected to an ultrasonic wave oscillator for transforming an electrical oscillation into a mechanical vibration, a mechanical vibration amplifying member secured to the ultrasonic transducer for amplifying the mechanical vibration, and an ultrasonic vibratory member, having a hollow cylindrical body structure, secured to the amplifying portion, is positioned downstream of the venturi. With this structure, fuel supplied through the nozzle in the fuel supplying device is atomized on the peripheral surfaces of the ultrasonic vibratory member.

41 Claims, 13 Drawing Figures

FIG. 2
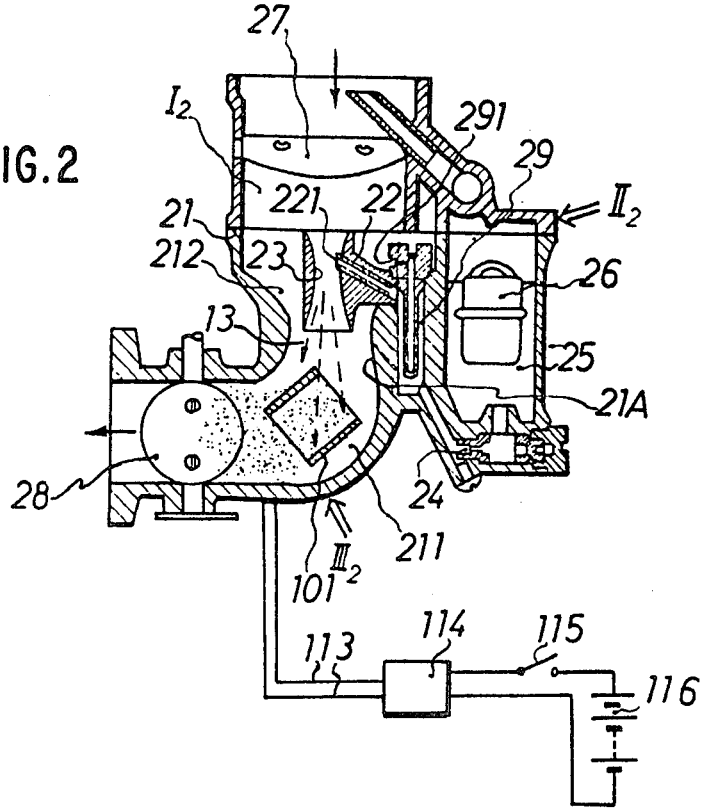
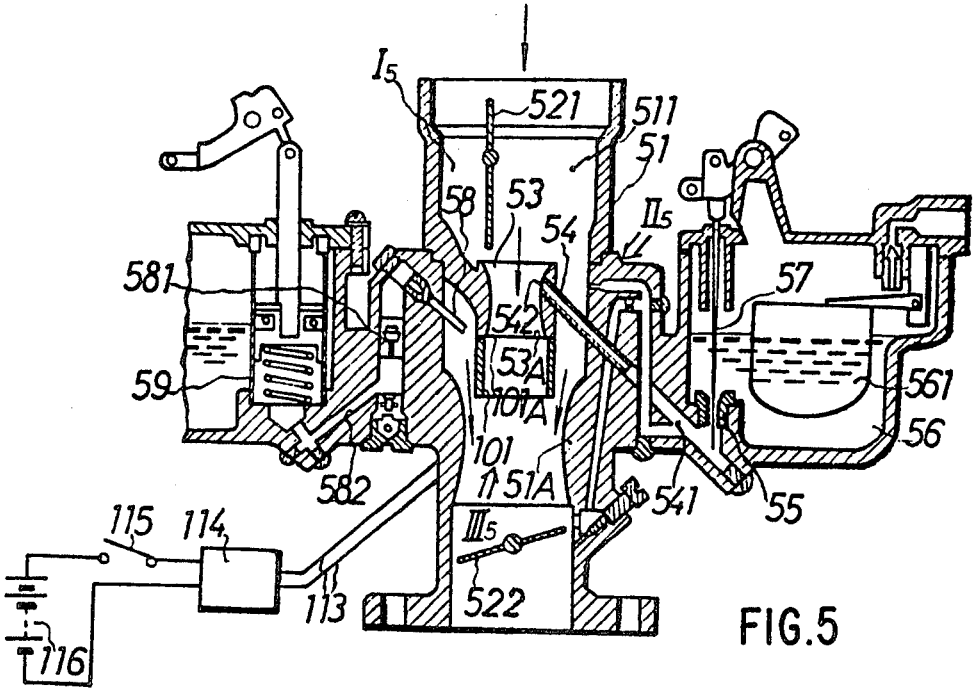
FIG. 5

FIG.4
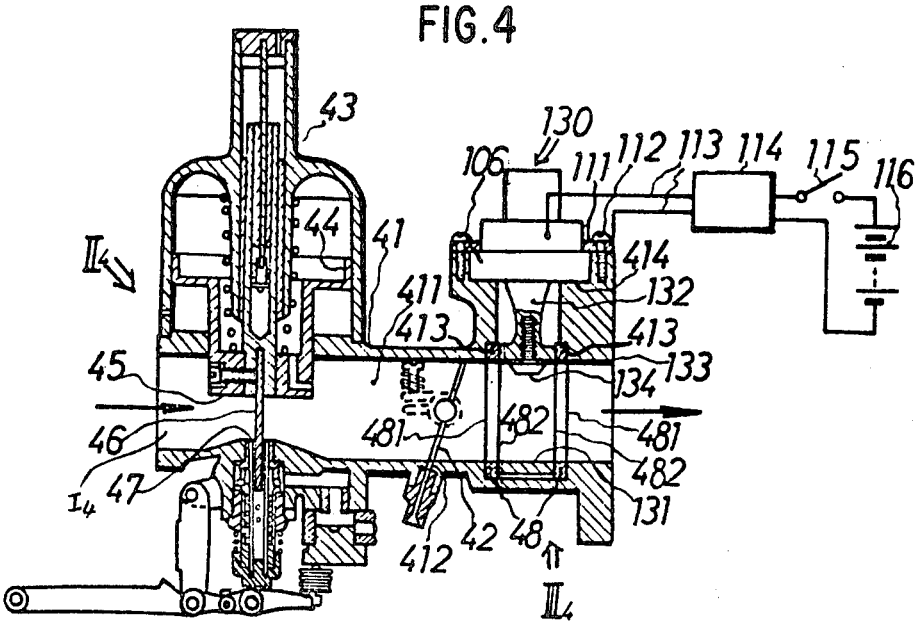
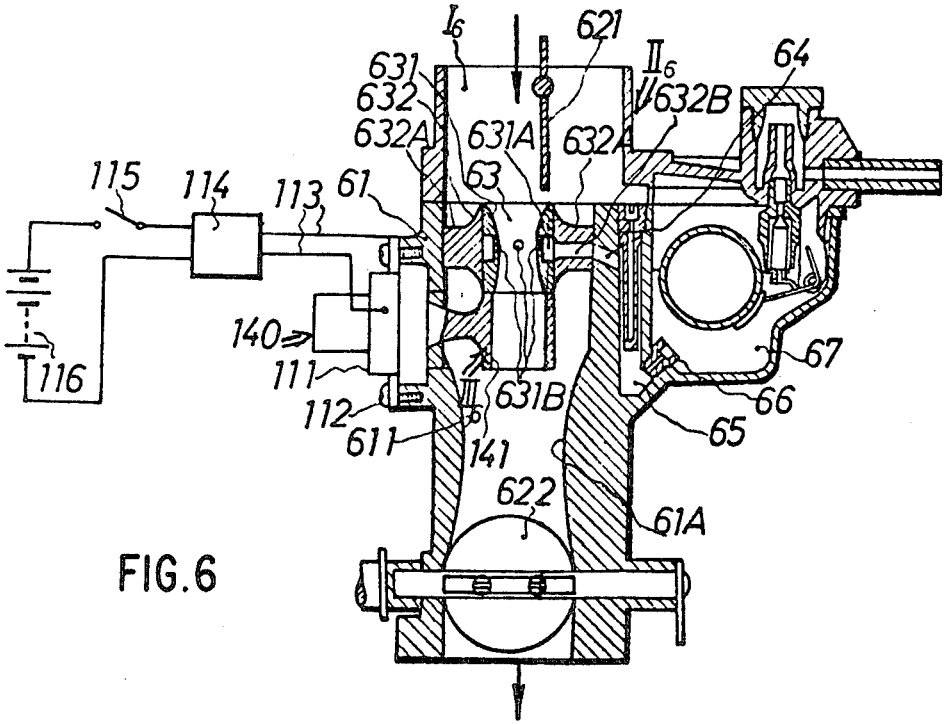
FIG.6

FIG.7
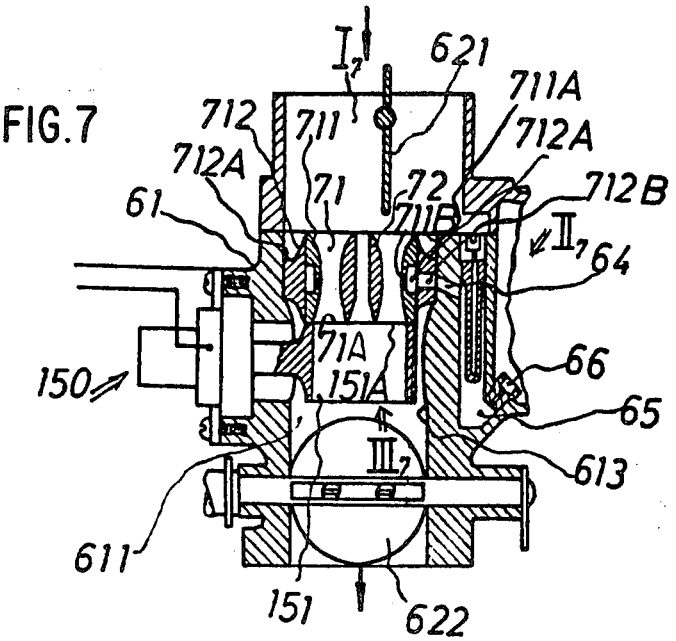
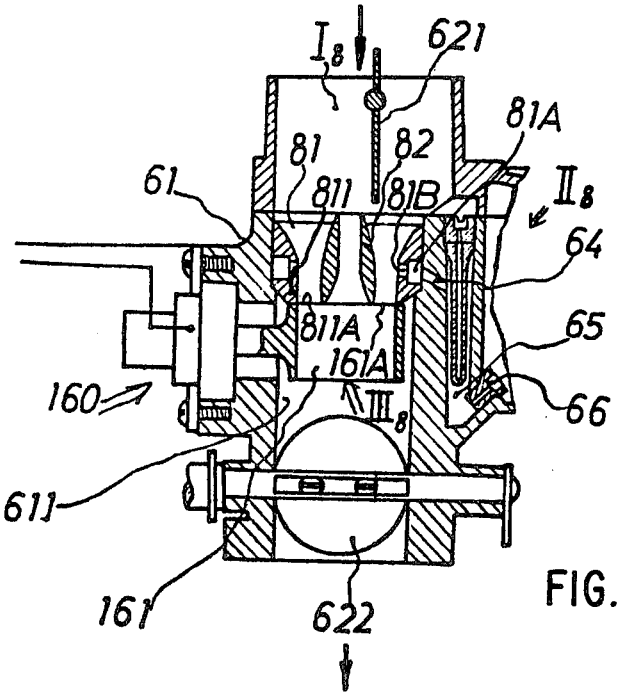
FIG.8

ULTRASONIC WAVE CARBURETOR

BACKGROUND OF THE INVENTION

1. Field of the Invention:

The present invention relates generally to engine carburetors, and more particularly, to an ultrasonic wave carburetor which may instantaneously atomize liquid fuel and mix the same with air by means of an ultrasonic vibratory member, having a hollow cylindrical body structure, which is positioned downstream of a venturi portion, thereby supplying a uniform air-fuel mixture to a combustion chamber of an engine.

2. Description of the Prior Art:

Prior art carburetors suffer from a failure in atomizing the fuel in an unsatisfactory manner, that is, in not continuously supplying a uniform air-fuel mixture to the respective cylinders of an automotive engine over the entire operational range of the automobile, extending from low speed to high speed conditions. This is particularly true with low-speed running of the engine, because poor fuel atomization results due to a low flow speed of the air streams travelling through the venturi portion, whereby the majority of the fuel clings to the wall of the passage, and the fuel in the form of liquid is produced thereon and flows along the wall of the passage. This is responsible for the aforenoted failure in achieving a uniform air-fuel mixture.

In light of such circumstances, many attempts have been proposed for the purpose of supplying a uniform air-fuel mixture to the engine in order to improve the engine performance and purify the exhaust gases. Typical of these are a carburetor of the type in which an electric heat-generating means is provided in the intake passage for gasifying the fuel by heat; a carburetor in which a heater utilizing the heat of the exhaust gases from the engine is provided for promoting gasification of the fuel by heat; a carburetor which is provided with a fuel atomizing means; and the like.

However, prior art carburetors using an electric heater pose the problem of needing to supply, by using the heater, an enormous amount of heat per unit time for gasifying the liquid fuel passing, in the form of streams, through the carburetor. This leads to the use of a great amount of electric power, and hence, difficulty in providing a practicable carburetor for an automobile.

The carburetor of this type also fails to maintain the provisions of a uniform air-fuel mixture because the flow rate of the liquid fuel passing through the heater is extremely varied under conditions wherein acceleration and deceleration are continuously repeated as in the case of an automotive engine, or the like. In addition, with an engine, in general, when the temperature of the air-fuel mixture is increased, the charging efficiency of the fuel is lowered, with an accompanying lowering of the output of the engine. It follows from this that the aforenoted carburetor necessarily suffers in lowering the output of the engine, because gasification of the fuel is accompanied by an increase in the temperature of the air-fuel mixture.

Similarly, with prior art carburetors for gasifying fuel by utilizing the heat of the exhaust gases from the engine, difficulty is confronted with starting the engine during cold weather and poor gasification of the fuel by means of a heater because the temperature of the exhaust gases is relatively low for a predetermined period of time immediately after starting the engine. Furthermore, heating means utilizing the heat of the exhaust gases are normally of complex construction in order to maintain desired functions and safety. Still further, a carburetor of this type tends to lower the output of the engine due to the fact that gasification of the fuel due to the heat of the exhaust gases is necessarily accompanied by an increase in the temperature of the air-fuel mixture with the resulting difficulty in controlling the temperature of the heater.

With a carburetor equipped with an ultrasonic wave fuel atomizing means, the atomizing area is normally insufficient, so that only a small amount of the fuel may be atomized per unit time, and a great amount of electric power is required for generating the ultrasonic waves, thus failing to meet the requirements arising from the practical application of the engine. Furthermore, prior art ultrasonic atomizing technology is only partially successful in providing an excessively large-sized atomizing means for achieving the desired atomization of the fuel for the engine, while suffering from the difficulty in not generating ultrasonic waves for a long period of time with high reliability, as well as from an increase in size of the carburetor, with an accompanying complexity of its construction.

SUMMARY OF THE INVENTION

The present invention is therefore directed to avoiding the shortcomings experienced with the aforenoted prior art carburetors.

It is an object of the present invention to provide an ultrasonic wave carburetor, in which liquid fuel, which has been introduced into an intake passage under suction conditions through a nozzle positioned in a fuel supply portion, is supplied to the peripheral surfaces of an ultrasonic vibratory member, positioned downstream of a venturi operatively associated with the fuel supply portion, in an amount commensurate with the flow rate of the streams passing through the venturi in the intake passage provided in a body of the carburetor, the aforenoted vibratory member having a hollow cylindrical shape and fuel atomizing surfaces of a large area, so that the fuel thus supplied thereto is instantaneously atomized due to the powerful ultrasonic-vibrations generated thereby. The fuel thus atomized may be thoroughly mixed with the air, vibrating due to ultrasonic waves produced, in a space surrounding the cylindrical body of the vibratory member, and gasification of the fuel may thus be promoted due to an agitating action of the air which is vibrating, whereby a uniform air-fuel mixture may be supplied to the combustion chambers of the engine.

It is another object of the present invention to provide an ultrasonic wave carburetor, in which fuel to be supplied through a low speed fuel supply system and an acceleration fuel supply system, as well, may be atomized by ultrasonic vibrations in the same manner as that of the fuel being supplied through a nozzle in a fuel supply means, followed by the subsequent thorough mixing with air so as to thereby supply a uniform air-fuel mixture to the combustion chambers of the engine.

It is still another object of the present invention to provide an ultrasonic wave carburetor, in which liquid fuel, being supplied through the aforenoted fuel supply systems, is supplied to an ultrasonic vibratory member having a hollow cylindrical body and a large surface area, which member is positioned, with its inner peripheral surface in registry with the inner peripheral wall of an intake passage of the carburetor, so as to thereby atomize liquid fuel which is flowing downstream along the aforenoted inner peripheral wall of the intake passage, the aforenoted liquid fuel being produced and conducted along the wall due to the insufficient atomization of the fuel by the air streams. The aforenoted liquid fuel may be instantaneously atomized by means of the powerful ultrasonic vibrations, the fuel thus atomized then being thoroughly mixed with air due to the ultrasonic vibrations produced within the intake air by means of the aforenoted vibratory member so as to thereby supply a uniform mixture to the combustion chambers of the engine.

According to the present invention, there is provided an ultrasonic wave carburetor which includes an intake passage for admitting fresh air and supplying an air-fuel mixture therethrough, and a fuel supply portion consisting of a fuel reservoir, a venturi provided in the intake passage, and a nozzle, one end of which is open into the venturi and the other end of which is communicated with a float chamber of the reservoir. A fuel atomizing device, consisting of an ultrasonic transducer connected to an ultrasonic wave oscillator for transforming an electrical oscillation into a mechanical vibration, a mechanical vibration amplifying member secured to the ultrasonic transducer for amplifying the mechanical vibrations, and an ultrasonic vibratory member, having a hollow cylindrical body structure, secured to the amplifying portion, is positioned downstream of the venturi in the intake passage, with its outer peripheral surface integrally secured to the mechanical vibration amplifying member.

With the aforenoted carburetor, the body of the ultrasonic wave generating portion consists integrally of an ultrasonic vibratory member, having a hollow cylindrical body and disposed in the fuel atomizing portion, an ultrasonic transducer, and an ultrasonic-wave amplifying portion. The body of the ultrasonic-wave generating portion is disposed in the fuel atomizing portion transforms an electrical oscillation generated by the ultrasonic wave oscillator, into a mechanical vibration, and then amplifies the mechanical vibrations thus transformed and transmits the vibrations thus amplified to the aforenoted ultrasonic vibratory member, the hollow, cylindrical, ultrasonic vibratory member, having a large surface area, then producing ultrasonic vibrations of a large amplitude.

According to the carburetor of the present invention, liquid fuel which has been metered commensurate with the flow rate of the air streams passing through the intake passage of the carburetor, is supplied to the ultrasonic vibratory member, having the hollow cylindrical body structure, in the fuel atomizing portion, and the fuel thus supplied may be instantaneously atomized into uniform minute particles, due to the ultrasonic vibrations, on the vibratory surfaces, of large area, of the vibratory member, so that atomized fuel, having a given particle size, is carried by the intake air into the combustion chambers of the engine. The particle size of the atomized fuel may be controlled by adjusting the vibratory energy which is dependent upon the variation in amplitude and frequency of the vibrations.

According to the present invention, liquid fuel in the fuel atomizing portion may be atomized due to the ultrasonic vibration of the aforenoted hollow cylindrical body in the fuel atomizing portion, and the atomized fuel may also be thoroughly mixed with the air undergoing ultrasonic vibrations within the intake passage by means of the ultrasonic vibratory member, thereby providing a uniform air-fuel mixture which in turn is supplied to the combustion chambers of the engine.

Furthermore, according to the present invention, since liquid fuel may be atomized due to the altrasonic vibrations, and mixed with air, the atomized condition of the fuel will not be affected by the flow speed of the air, so that an air-fuel mixture of a consistent, uniform air-fuel ratio may be continuously supplied to the engine over the entire operative range of the engine, extending from low speed to high speed operation. Thus, combustion of a lean mixture is enabled, thereby preventing production of unburned combustion gases, and a conservation fuel.

The ultrasonic wave carburetor constructed according to the present invention exhibits the fact that liquid fuel may be atomized into minute particles due to ultrasonic vibrations, and subsequently mixed with air, so that a uniform distribution of the fuel into the respective combustion chambers of a multiple-cylinder engine may result. The carburetor constructed according the present invention also facilitates the starting of the engine during cold weather, and enables the running of the engine without lowering the charging efficiency of the air-fuel mixture because the mixture is not heated.

The ultrasonic wave carburetor constructed according to the present invention provides four characteristic aspects:

The first aspect of the present invention features an ultrasonic vibratory member, having a hollow cylindrical body structure, disposed in a fuel atomizing portion of an intake passage downstream of a nozzle of a fuel supply portion which consists of a venturi disposed in the intake passage in the carburetor, and a fuel nozzle communicated with a float chamber and opening into the venturi, the axis of the aforenoted ultrasonic vibratory member being inclined at a given angle with respect to the axis of the venturi in the carburetor.

According to the first aspect of the present invention, an electrical oscillation, generated by an ultrasonic wave oscillator disposed in a fuel atomizing portion, is transduced into a mechanical vibration by means of transducer elements, and subsequently, the mechanical vibration thus transduced is amplified in an ultrasonic vibration amplifying portion. The vibratory displacements of the vibrations thus amplified are transmitted to the peripheral surfaces of a vibratory member, having a hollow cylindrical body structure, whereby the vibratory member generates ultrasonic vibrations with a large amplitude. Fuel, which has been injected upstream thereof by a fuel nozzle, is directed so as to impinge upon the inner outer peripheral surfaces of the vibratory member with the aid of the air streams passing through a venturi under suction or vacuum conditions from the engine, and the fuel thus impinging thereon is instantaneously atomized due to the ultrasonic vibrations on the vibratory member, which fuel thus atomized is thoroughly mixed with the air due to the ultrasonic vibrations produced in the air within the intake passage by the vibratory member, whereby the mixture is supplied through an intake pipe into a combustion chamber of an engine in the form of fluid streams.

The aforenoted carburetor is capable of atomizing a great amount of fuel per unit of time, because the fuel may be instantaneously atomized on the inner and outer peripheral surfaces of the hollow, cylindrical vibratory member, and the fuel thus atomized may be provided in the form of extremely fine particles, thereby achieving the aforenoted advantages of the present invention.

The second aspect of the present invention features the inner peripheral surface of the vibratory member being positioned in registry with the peripheral wall of the intake passage, downstream of the venturi within the intake passage of the carburetor.

According to the second aspect of the present invention, an ultrasonic vibratory member having its inner peripheral surface in registry with the peripheral wall of the intake passage in the carburetor is positioned downstream of the venturi in the intake passage, and the ultrasonic vibratory member generates ultrasonic vibrations as in the first aspect, while fuel which has been introduced under suction conditions through an idle port, is supplied along the peripheral wall of the intake passage to the vibratory surface of the vibratory member during idling of the engine. In addition, at the time of low and intermediate speed operations of the engine, liquid fuel flowing along the peripheral wall of the intake passage, resulting from insufficient airstream atomization, is supplied to the vibratory surfaces of the vibratory member which thereby instantaneously atomizes the liquid fuel due to the ultrasonic vibrations generated thereby, while the fuel thus atomized is subsequently thoroughly mixed with the air due to the ultrasonic vibrations of the air in the form of a column formed within the intake passage, followed by supply of the mixture to a combustion chamber of an engine. This aspect also provides the aforenoted advantages of the carburetor according to the present invention.

The third aspect of the present invention features an ultrasonic vibratory member being positioned in such a manner that its axis is positioned coaxially or in alignment with the axis of the venturi, and the inner peripheral surface of the vibratory member is in registry with and contiguous to an annular wall of the venturi, while the exit of a fuel nozzle open from the wall surface of the venturi.

According to the third aspect of the present invention, an ultrasonic vibratory member, having its inner peripheral surface in registry with the annular wall of a venturi at the downstream end thereof, causes ultrasonic vibrations as in the first aspect, while fuel, which has been introduced under suction conditions through an exit of a nozzle due to the air streams passing through the venturi, is supplied so as to flow along the wall surface of the venturi to the aforenoted vibratory member, wherein the fuel is instantaneously atomized due to the ultrasonic vibrations generated upon the vibratory member. The fuel thus atomized is then thoroughly mixed with the air due to the ultrasonic vibrations generated in the air within the intake passage by means of the aforenoted vibratory member, whereby a mixture, in the form of streams, is supplied through the intake passage to an engine combustion chamber. The aforenoted carburetor may completely atomize the fuel being supplied from the fuel supply portion, due to the ultrasonic vibrations, thus presenting the aforenoted advantages of the preceding aspects of the invention.

The fourth aspect of the present invention features the fuel atomizing chamber being positioned downstream of a throttle plate within an intake passage of the body of the carburetor but being spaced a given distance from the venturi, such as, for example, in a joint portion of an intake manifold and/or within an intake manifold, while the ultrasonic vibratory member in the fuel atomizing portion is positioned in such a manner that the inner peripheral surface of the vibratory member is in registry with the inner peripheral surface of the exit portion of the intake passage.

According to the fourth aspect of the present invention, an ultrasonic vibratory member, whose inner peripheral surface is in registry with the inner peripheral surface of the exit portion of an intake passage which is disposed upon an extension of a downstream portion of the intake passage in a carburetor, generates ultrasonic vibrations of large amplitude, while liquid fuel, which is flowing along the inner peripheral wall of the carburetor into the intake pipe of the engine, is supplied to the inner peripheral surface of the vibratory member, the latter thereby instantaneously and completely atomizing the fuel due to the ultrasonic vibrations generated thereby, the same being followed by a thorough mixing with air so as to give a mixture which is then supplied to the combustion chamber of the engine. The aforenoted ultrasonic wave carburetor may be adopted as a fuel supply portion without any other modification being necessary to a prior art carburetor.

According to the fourth aspect of the invention, atomization of the fuel may be carried out at a position closer to the combustion chamber of the engine, as compared with the preceding aspects, so that the distance to be covered by the flow of the atomized fuel to the combustion chamber may be shortened, while the intake pipe may be heated by means of the heat from the engine. As a result, atomized fuel will not cling to the wall surface of the intake pipe, and hence, a uniform mixture may be supplied to the combustion chamber.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein:

FIG. 2 is a schematic, cross-sectional view, partly in elevation, showing the second embodiment of the ultrasonic wave carburetor according to the present invention;

FIG. 4 is a schematic, cross-sectional view, partly in elevation, showing the fourth embodiment of the carburetor of the invention;

FIG. 5 is a schematic, cross-sectional view, partly in elevation, showing the fifth embodiment of the carburetor of the invention;

FIG. 6 is a schematic, cross-sectional view, partly in elevation, showing the sixth embodiment of the carburetor of the invention;

FIG. 7 is a schematic, cross-sectional view, partly in elevation, showing the seventh embodiment of the carburetor of the invention;

FIG. 8 is a schematic, cross-sectional view, partly in elevation, showing the eighth embodiment of the carburetor of the invention;

DETAILED DESCRIPTION OF THE ILLUSTRATED EMBODIMENTS

Figure 1A:
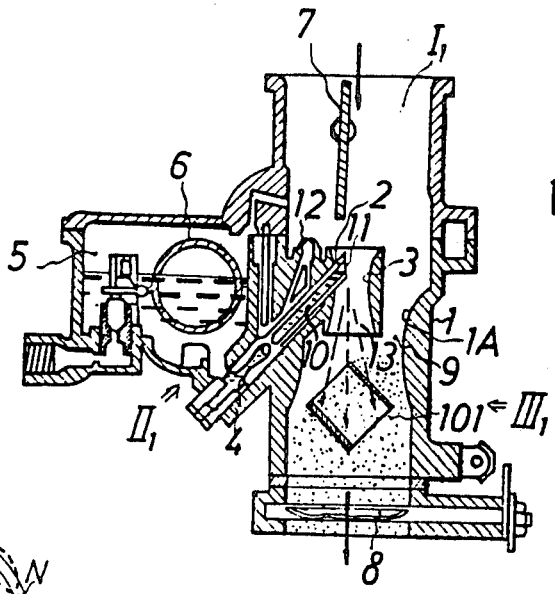
FIG. 1(a) is a cross-sectional view illustrative of the first embodiment of an ultrasonic wave carburetor according to the present invention.

The first and second embodiments of the present invention are part of the first aspect of the present invention, and a description will now be given of the first embodiment of the present invention in conjunction with FIGS. 1(a) - 1(c).

The ultrasonic wave carburetor of the first embodiment features an ultrasonic vibratory member 101, having a hollow cylindrical body and disposed within a fuel atomizing portion $III_1$, and which is positioned below the exit of a main nozzle 2 disposed within a fuel supply portion $II_1$, the latter of which is, in turn, disposed within the central hollow portion of an intake passage $I_1$. The intake passage $I_1$ is adapted to admit fresh air and to supply an air-fuel mixture therethrough, and the axis of the ultrasonic vibratory member 101 is inclined, at an angle, for example of 45°, with respect to the axis of a venturi portion 3 in the fuel supply portion $II_1$. This embodiment employs a fuel supply portion $II_1$ of a zenith type carburetor.

An intake barrel 9 is defined within the intake passage $I_1$ and more particularly within a body 1 of the carburetor. A choke valve 7 is positioned upstream of the intake barrel 9 while a throttle valve 8 is positioned downstream thereof, a main venturi portion 1A and the fuel venturi portion 3 being provided within the intake barrel 9. Protruding into the venturi portion 3 is the main fuel nozzle 2 which is in communication, through means of an emulsion pipe 10 and a main jet 4, with a float chamber 5 serving as a fuel reservoir source, the exit 11 of the nozzle 2 being open within venturi 3. A dome-shaped air bleed 12 is provided within the main fuel supply system of the carburetor, and a float 6 is provided so as to maintain the level of the liquid fuel within float chamber 5 at a predetermined value.

Figure 1C:
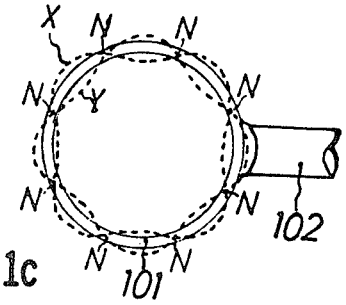
FIG. 1(c) is a schematic plan view showing one example of the operating conditions of the vibratory member of the carburetor of FIG. 1(a)
Figure 1B:
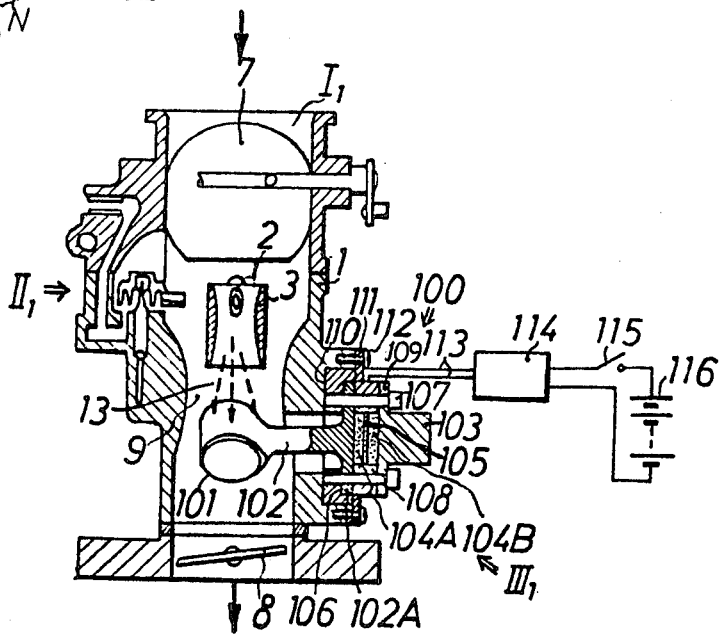
FIG. 1(b) is a schematic, elevation view, partly in cross-section, of the carburetor of FIG. 1(a)

Secured to the side wall of the body 1 of the carburetor is an ultrasonic wave generating portion 100 which includes the ultrasonic vibratory member 101 and which constitutes the fuel atomizing portion $III_1$, as best seen in FIGS. 1(a) and 1(b). The ultrasonic vibratory member 101 protrudes into the central portion of the intake barrel 9 in the carburetor and is disposed below the exit 11 of the main fuel nozzle 2, the axis of the vibratory member 101 being inclined at an angle of 45° with respect to the axis of the venturi 3, and in this manner, fuel being supplied through means of the venturi 3 is received upon the inner and outer peripheral surfaces of the member 101.

The ultrasonic wave generating portion 100 may generate powerful ultrasonic waves, and is of such small size that the portion 100 may be built into the body 1 of the carburetor. More particularly, the ultrasonic wave generating portion 100 is of a unique construction, in which piezoelectric elements 104A and 104B are sandwiched between a backing block 103 and an ultrasonic-vibration amplifying block 102, the vibratory member 101, having a hollow cylindrical body construction, being integrally secured to the tip of the amplifying block 102. The ultrasonic-vibration amplifying block 102 is a stepped type horn, serving as a mechanical vibration amplifying portion, and more specifically, the ultrasonic vibration amplifying block 102 serves as an ultrasonic-wave transducer with the aid of the piezoelectric elements 104A and 104B and the backing metal block 103. Block 102 therefore also serves as a horn which amplifies the mechanical vibrations which have been produced in the ultrasonic-wave transducing portion.

The vibratory member 101 is designed so as to cause vibrations or flexural vibrations, as shown in FIG. 1(c), to occur within the intake barrel 9 in the carburetor body 1 at a frequency identical to that of the ultrasonic vibrations which have been transduced by means of the piezoelectric elements 104A and 104B and whose amplitude has been amplified by horn 102, the axis of the vibratory member 101 being maintained at a right angle with respect to the vibratory direction of the ultrasonic wave amplifying block 102. The vibratory member 101 is integrally formed with or secured to the tip of the block 102, and a root portion of the block 102 is formed with a flange 102A which has a plurality of bolt holes therein for receiving bolts 107 therethrough.

An annular supporting plate 106, which reinforces the bending ridigity of the flange 102A by being fitted thereon, is formed with holes having female threads which may be engaged with threaded portions of bolts 107 so as to be integrally fastened to an annular flange 109 of the backing block 103 by means of the bolts 107, through the medium of the piezoelectric elements 104A and 104B, an electrode plate 105, and a spacer plate 108.

The ultrasonic-wave generating portion 100 is integrally secured to the external side wall of the body 1 of the carburetor, the annular supporting plate 106 being fitted in a seat or recess 110 formed in the outer sidewall of the body 1 of the carburetor, the same being secured in position through the medium of a holding plate 111 by means of a plurality of screws 112, the axis of the vibratory member 101 being maintained at an angle of 45° with respect to the axis of the venturi 3.

The electrode plate 105 and holding plate 111 of the ultrasonic-wave generating portion 100 connect with electrical-oscillation-input-lead wires 113 which are connected with the output side of an ultrasonic wave oscillator 114, the input side of the oscillator 114 being connected, by means of a vibratory-member-starting switch 115, to an electric power source 116. In case the ultrasonic wave carburetor constructed according to the present invention is applied to an automotice engine, for example, the vibratory member starting switch 115 may cooperate with a switch for use with an ignition coil or with an engine starting switch, while the electric power source 116 is provided in the form of a dynamo or battery. The tubular member forming the fuel atomizing portion $III_1$ is integrally secured by means of its flange to an intake manifold, not shown, and is communicated, through the medium of intake passage $I_1$, and passages in the intake manifold, with respective combustion chambers of the engine.

In operation of the first embodiment of the present invention, when the vibratory-member-starting switch 115 is closed due to the starting operation of the internal combustion engine, an electrical oscillation, having the same frequency as that of a resonance frequency of the ultrasonic-wave-generating portion 100, is generated at the ultrasonic wave oscillator 114, and is then transmitted to the piezoelectric elements 104A and 104B, respectively, thereby inducing ultrasonic vibrations. The ultrasonic vibrations thus created then cause vertical vibration in the ultrasonic vibration amplifying block 102, with a vibrational node appearing on the end face of the flange 102A of the ultrasonic-vibration-amplifying block 102, which face is positioned on the side of the annular supporting plate 106, whereupon the block 102 amplifies the amplitude of the vibrations. The vibratory displacements of the vibrations thus amplified are then transmitted to the ultrasonic vibratory member 101 having a hollow cylindrical body structure, and as a result, the aforenoted vibratory member 101, which is positioned below the exit 11 of the main fuel nozzle 2 in the carburetor, causes vibrations or flexural vibrations to occur with a large amplitude.

This will be described in greater detail, with respect to the fourth order flexural vibrations of the vibratory member, in conjunction with FIG. 1(c). The vibratory member 101 causes elastic deformation, as shown by the wavy chain line X, to occur at half cycle periods of vibration, while presenting vibrational nodes, appearing as shown at N, and similarly causes another type of elastic deformation, shown by an inverted chain line Y relative to the chain line X, to occur at subsequent half cycle periods or locations. For instance, in the case of a frequency of 40 KHz, the vibratory member 101 repeats the elastic deformations of the aforenoted pattern 40,000 cycles per second.

The vibratory member 101 may generate powerful ultrasonic waves upon vibratory surfaces of a large surface area, that is, the inner and outer peripheral surfaces of the hollow cylindrical body. Fuel, normally retained in the float chamber 5, is directed under suction or vacuum conditions prevailing in the venturi portion of the carburetor by way of the main jet 4, emulsion pipe 10, main fuel nozzle 2, and exit 11 of the main fuel nozzle 2, so as to be discharged therefrom, and carried downwardly through venturi 3 on air streams travelling therethrough. The fuel thus injected impinges on the inner and outer peripheral surfaces of the hollow vibratory member 101, as shown by the broken lines 13, as a result of the vibratory member 101 being disposed with its axis inclined at an angle of 45° with respect to the axis of the venturi portion 3 in the carburetor, and the fuel thus impinging on the surfaces of the vibratory member 101 is therefore spread over the entire vibratory surfaces thereof, due to the ultrasonic vibrations, so as to form a liquie film thereon which is then atomized into very minute particles and scattered about and discharged from the vibratory surfaces of the member 101.

The particles of fuel thus atomized are very small in size, as compared with that of fuel particles which are injected through the exit 11 of the nozzle 2, and are thoroughly mixed with air by means of powerful ultrasonic vibrations generated in the air streams within the intake barrel 9 by means of the vibratory member 101. The air-fuel mixture is then of course supplied through an intake pipe, not shown, to the combustion chamber of the engine in the form of streams.

As is apparent from the foregoing, the ultrasonic wave carburetor according to this embodiment may provide an air-fuel mixture of a uniform air-fuel ratio, thereby permitting combustion of a lean mixture, with a resulting saving in fuel and purification of exhaust gases due to a reduction in the amount of unburned harmful gases. The carburetor according to the first embodiment of the invention is seen to effectively use as atomizing surfaces the inner and outer peripheral surfaces of the vibratory member 101 having a hollow cylindrical body construction of a large surface area, so that a great amount of fuel maybe instantaneously atomized, thus lending itself to a wide range of operating conditions of the engine.

In addition, fuel which is flowing through the intake barrel 9 will encounter the vibratory surfaces of the member 101 for atomization, as well as for the subsequent mixing with the air, thereby providing an air-fuel mixture of a uniform air-fuel ratio, which mixture is then uniformly distributed into the respective engine cylinders. Still further, the carburetor according to this embodiment is not intended to atomize fuel according to a heating technique, thereby enabling the retention of a desired charging efficiency of an air-fuel mixture into the respective cylinders.

The first embodiment of the present invention also provides the advantage of an improved atomizing efficiency, over that of a prior art carburetor, because fuel which has been atomized to some degree by means of the venturi in the fuel supply portion $II_1$ is completely atomized in the fuel atomizing portion $III_1$. Yet further, a vibratory input for the vibratory member 101 may be controlled so as to thereby control the size of the particles of fuel in the atomized form, thereby providing fuel particles of a given uniform size, unlike prior art carburetors and fuel injection means.

A description will now be given of a second embodiment of the present invention by referring to FIG. 2, wherein it is seen that the ultrasonic wave carburetor constructed according to the second embodiment of the present invention features an intake barrel 212, serving as an intake passage $I_2$ for admitting fresh air and an air-fuel mixture therethrough, bent at an angle of approximately 90° at a position downstream of the main venturi portion 21A in the carburetor, unlike the preceding embodiment, and a vibratory member 101, having a hollow cylindrical body, is disposed in the atomizing portion $III_2$ and more particularly within the bent portion 211 of the aforenoted intake barrel 212 with its axis being inclined at an angle with respect to the axis of the internal venturi 23, but nevertheless disposed along the streamlines of the fluid passage through the aforenoted bent portion 211.

The second embodiment employs a fuel supply portion $II_2$ of an ordinary carburetor, and the intake barrel 212, serving as the intake passage $I_2$, is defined in the body 21 of the carburetor, while the main venturi portion 21A is disposed within the intake barrel 212, a venturi 23 also being disposed therein. In addition, the intake barrel 212 is bent at an angle of approximately 90° at a position downstream of the main venturi portion 21A of the carburetor and positioned in the upstream portion of the intake barrel 212 is a choke valve 27, while a throttle valve 28 is positioned in the downstream portion thereof.

Protruding from and opening into the inner surface of the venturi 23 is an exit 221 of a main fuel nozzle 22 which is communicated, through means of an air bleed chamber 29 and a main jet 24, with a float chamber 25 serving as a fuel supply source, the air bleed chamber 29 being provided in the main fuel supply system of the carburetor, with one end of the chamber 29 being communicated, through means of an air bleed 291, with the atmosphere. A float 26 is disposed within chamber 25 so as to maintain the level of the liquid fuel within float chamber 25 at a constant predetermined height.

Secured to the side wall of the intake-barrel-bent portion 211 of the body 21 of the carburetor is an ultrasonic-wave-generating portion, not wholly shown, having an ultrasonic vibratory member 101, having a hollow cylindrical body, which constitutes the fuel atomizing portion $III_2$ as in the case of the first embodiment. The vibratory member 101 is so positioned as to protrude into the intake-barrel-bent portion 211 in the carburetor at a position below the exit 211 of the main fuel nozzle 22, as well as below venturi 23, with the axis of the vibratory member 101 being inclined at an angle of 45° with respect to the axis of the venturi 23, as a result of which, one open end of the cylindrical body is directed substantially in the upstream direction of the aforenoted intake barrel 212, while the other open end is directed substantially in the downstream direction of the intake barrel 212.

In conjunction therewith, construction of the ultrasonic wave generating portion and other members of the system are the same as those of the first embodiment, and thus, a description thereof is omitted herefrom. Lead wires 113 are connected to the output side of an ultrasonic wave oscillator 114 and to the ultrasonic-wave-generating body, while the input side of the oscillator 114 is connected by means of a vibratory-member-starting switch 115 to an electric power source 116, such as, for example, a dynamo or battery.

In operation of the second embodiment of the present invention, when the vibratory-member-starting switch 115 is closed due to the starting operation of the internal combustion engine, an electric oscillation is transmitted from the ultrasonic wave oscillator 114 to the ultrasonic-wave-generating portion so as to be transformed into an ultrasonic vibration. The ultrasonic vibration thus transformed is then amplifed and transmitted to the ultrasonic vibratory member 101, and accordingly, the vibratory member 101, which has been disposed below the exit 221 of the main fuel nozzle 22 in the carburetor, generates ultrasonic vibrations of a large amplitude, as in the preceding embodiment, thereby generating powerful ultrasonic waves from the vibratory surfaces of large area, that is, the inner and outer peripheral surfaces of the vibratory member 101.

Fuel within the float chamber 25 is introduced, under suction or vacuum conditions prevailing in the venturi portion in the carburetor, through means of the main jet 24, air bleed chamber 29, main fuel nozzle 22, and exit 221 of the main fuel nozzle 22 into venturi 23 so as to be carried downwardly on air streams passing through venturi 23. The fuel thus injected impinges upon the inner and outer peripheral surfaces of the vibratory member 101, as shown by broken lines 13, as a result of the axis of the vibratory member 101 being inclined at an angle with respect to the axis of the internal venturi 23. The fuel thus impinging on the surfaces of the vibratory member 101 is spread over the vibratory surfaces thereof due to the ultrasonic vibrations generated thereby so as to form liquid films thereon which are atomized into very fine particles which become scattered about therefrom. Since the axis of the vibratory member 101 in this embodiment is directed along the streamlines of the air flow passing through the intake-barrel-bent portion 221, the minute particles thus atmoized may flow smoothly in the downstream direction of the intake barrel therethrough.

In this embodiment, as in the first embodiment, minute particles of fuel, atomized due to the ultrasonic vibrations, are small in size as compared with fuel particles being injected through the exit 221 of the main fuel nozzle 22 and may be thoroughly mixed with air within the intake barrel 212 due to the powerful ultrasonic vibrations generated in the air streams by the aforenoted vibratory member 101, the mixture thus being provided through an intake pipe to the combustion chamber of the engine. Accordingly, the ultrasonic wave carburetor according to the second embodiment may supply a mixture of a uniform air fuel ratio, thus permitting combustion of a lean mixture, with a resulting saving in fuel and reduction in the amount of harmful unburned combustion gases.

The carburetor according to the second embodiment may instantaneously atomize a great amount of fuel and functions satisfactorily over a wide range of operating conditions extending from low speed to high speed running of the engine, because the vibratory member 101 is positioned at an angle with respect to the axis of the venturi portion 23 and provides inner and outer peripheral surfaces having a large surface area for atomization of the fuel. The carburetor of the second embodiment thus provides a remarkable atomizing effect, as compared with prior art carburetors, by completely atomizing the fuel in the fuel atomizing portion $III_2$ which has already been atomized, in the venturi of the fuel supply portion $II_2$, to some degree.

Furthermore, fuel which is flowing through the intake barrel 212 is collected on the surfaces of the vibratory member 101 and atomized thereby, thus providing an air-fuel mixture having a uniform air-fuel ratio and permitting a uniform distribution of the mixture to the respective cylinders of an engine. Still further, the carburetor according to the second embodiment of the present invention is not intended to vaporize fuel with heat, thus retaining a desired charging efficiency of the air-fuel mixture to the respective cylinders.

While the description has been given of the first aspect of the present invention by referring to the first and second embodiments in which a vibratory member, having a hollow cylindrical body, is placed at an angle of 45° with respect to the axis of the intake passage, the first aspect of the invention is by no means so limited, and thus, various angles for the vibratory member may be adopted depending upon the amount of fuel to be encountered, the resistance of the flow through the intake passage, the diameter and length of the vibratory member, and the direction or curvature of the intake passage.

Figure 3:
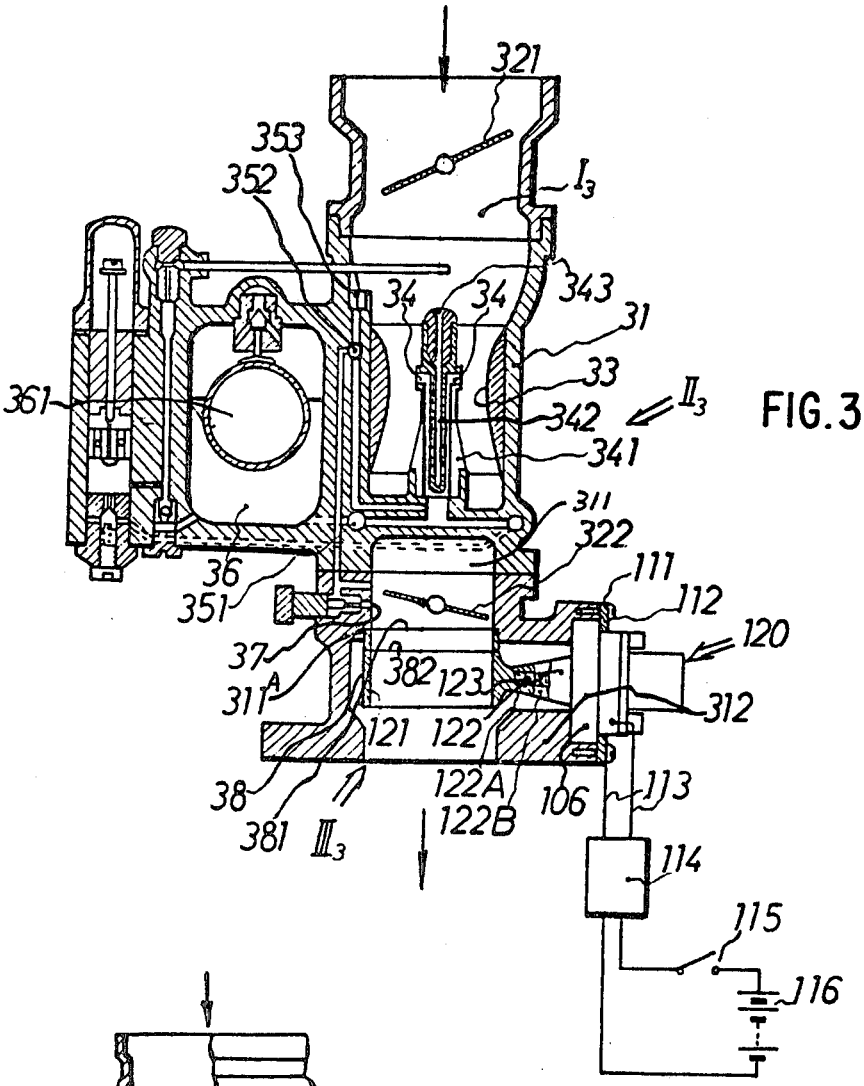
FIG. 3 is a schematic, cross-sectional view showing the third embodiment of the carburetor of the invention.

The description will now continue with the second aspect of the present invention by referring to the third and fourth embodiments thereof and FIGS. 3 and 4. The ultrasonic wave carburetor of the third embodiment features an ultrasonic vibratory member 121, having a hollow cylindrical body structure and disposed in an ultrasonic-wave-generating body 120, as the fuel atomizing portion $III_3$ which is positioned downstream of a fuel supply portion $II_3$ within an intake passage $I_3$ which is adapted to admit fresh air and supply an air-fuel mixture therethrough, with the inner peripheral surface of the vibratory member 121 being in rigistry with the inner peripheral surface of the intake passage. The third embodiment adopts the fuel supply portion $II_3$, of the Solex type carburetor, and the intake barrel 311, serving as the intake passage $I_3$, is defined in a body 31 of the carburetor, while a choke valve 321 is positioned in the upper portion of the intake barrel 311 and a throttle valve 322 is positioned in the lower portion of the intake barrel 311.

A venturi portion 33 is positioned within the aforenoted intake barrel 311 and a mixing-pipe cap 341 is disposed along the central axis of the venturi portion 33 with a mixing pipe 342 housed therein. In addition, positioned within the aforenoted mixing-pipe cap 341 there is also disposed a main fuel nozzle 34 which is communicated, through means of a passage between the mixing pipe cap 341 and mixing pipe 342, and through a main jet 351, with a float chamber 36, with the exit of the nozzle 34 opening into the intake barrel 311 of the carburetor. An air bleed 343 is provided in the cap 341 of the main fuel supply system of the carburetor, and a float 361 is disposed in chamber 36.

Defined in the side wall of the body 31 of the carburetor in the downstream portion of the intake barrel 311 is an idling port 37 adapted to supply fuel during a no-load operation of the engine, and a low speed jet 352 is provided in a low-speed fuel supply system which includes a low-speed air bleed 353.

The ultrasonic vibratory member 121, having a hollow cylindrical body, is part of an ultrasonic-wave-generating body 120 positioned in the downstream portion of the intake barrel 311 in the carburetor at a position below the idling port 37, with the axis of the cylindrical body being in alignment with the axis of the intake barrel 311 and with the inner peripheral surface of the vibratory member 121 being in registry with the peripheral wall of the intake barrel 311 in the carburetor, so that the inner peripheral surface of the vibratory member 121 forms part of the peripheral wall of the intake barrel 311.

In this case, the peripheral wall of the intake barrel 311 is continuous, through means of an annular ring 38, with the inner peripheral surface of the vibratory member 121, one end 381 of the annular ring 38 being disposed in an annular shoulder portion 311A formed in the peripheral surface of the intake barrel 311 while the other end 382 thereof abuts an annular end face of the aforenoted vibratory member 121. An annular supporting plate 106 is disposed within a counterbored portion, not numbered, of a seat support 312 integrally provided on the outer wall of the body 31 of the carburetor and is secured through the medium of a supporting plate 111, to the body 31 of the carburetor by means of a plurality of screws 112, so that the ultrasonic-wave-generating body 120 is likewise secured to the body 31 of the carburetor.

In this respect, the ultrasonic-generating body 120 is formed with an ultrasonic vibration-amplifying block 122 having a configuration of a conical horn which consists of two members 122A and 122B. The aforenoted vibratory member 121 is integrally secured to the tip portion 122A of the mechanical vibration output portion of the ultrasonic vibration amplifying block 122, while the tip portion 122A is integrally coupled to the rear end portion 122B of the amplifying block 122 by means of a bolt 123. In this manner, the tip rear end portions of the amplifying portion integrally form the ultrasonic-vibration-amplifying block 122 in the ultrasonic-wave-generating body 120. As the construction of the other members of the ultrasonic-wave-generating body 120 is identical to that of the first embodiment, a detailed description of the same has been omitted herefrom. Lead wires 113 are of course connected to the ultrasonic-wave-generating body 120 and the output side of an ultrasonic-wave oscillator 114, while the input side of the oscillator 114 is connected, through means of a vibratory-member-starting switch 115, to an electric power source 116.

In operation of the third embodiment of the carburetor constructed according to the present invention, when the vibratory-member-starting switch 115 is closed due to the starting operation of the internal combustion engine, an electrical oscillation is transmitted to the ultrasonic-wave-generating body 120 from the ultrasonic wave oscillator 114, when the electrical oscillation is transduced into an ultrasonic vibration. The ultrasonic vibrations thus transduced are amplified in their amplitudes, and are then transmitted to the ultrasonic vibratory member 121, having the hollow cylindrical body, in the ultrasonic-wave-generating body 120. As a result, the vibratory member 121, disposed with its inner peripheral surface in registry with the peripheral wall of the intake barrel 311 in the carburetor generates vibrations or flexural vibrations, as shown in FIG. 1(c), of a large amplitude, thus producing powerful ultrasonic waves from the vibratory surfaces, of a large area, of the vibratory member, the aforenoted vibratory surfaces of the vibratory member being composed of the inner and outer peripheral surfaces thereof.

Meanwhile, fuel within the float chamber 36, at the time of idling of the engine, is introduced, under suction or vacuum conditions prevailing in the intake barrel 311 downstream of the throttle valve 322, through means of the low speed jet 352 and idling port 37 so as to flow along the inner peripheral wall of the intake barrel 311 disposed immediately below the idling port 37 and along the inner peripheral surface of the annular ring 38 to the inner peripheral surface of the vibratory member 121. The fuel which has reached the vibratory member is then of course spread over the vibratory surfaces of the member 121 due to the ultrasonic vibrations thereof so as to form liquid films thereon, whereupon the liquid films thereon are atomized into minute particles and then scattered around and discharged from the vibratory surfaces thereof.

During normal running of the engine, fuel within the float chamber 36 is directed, under suction conditions, through main jet 351, the passage defined between the mixing-pipe cap 341 and the mixing pipe 342, and through the main fuel nozzle 34 so as to be injected into the intake barrel 311. In this case, particularly during the times of low and medium speed runnings of the engine, the flow speed of the air streams flowing through the venturi portion 33 is low, so that a majority of the fuel injected through the main fuel nozzle 34 is insufficiently atomized and flows toward the downstream portion of the intake-barrel 311 along the wall surface thereof.

The fuel thus flowing along the inner peripheral wall of the intake barrel 311 in the carburetor is, however, then supplied along the inner peripheral surface of the annular ring 38 to the inner peripheral surface of the vibratory member 121 for complete atomization on the vibratory surfaces thereof. The atomized fuel particles are then thoroughly mixed with air due to the powerful ultrasonic vibrations which are generated in the air streams by means of the vibratory member 121, and such mixture is then supplied through an intake pipe, not shown, by means of the air streams, and to the engine combustion chambers. The ultrasonic wave carburetor according to this embodiment may thus provide the excellent function of providing an air-fuel mixture of a uniform air-fuel ratio for the engine, particularly during low and medium speed operations of the engine.

According to this embodiment then, fuel which has not been atomized in the venturi portion of the fuel supply portion $II_3$ and which flows along the peripheral wall of the intake barrel 311 is in fact fully atomized by means of the vibratory member 121, having the hollow cylindrical body structure and whose inner peripheral surface is in registry with the peripheral wall of the intake barrel 311, the fuel then being thoroughly mixed with air so as to thereby provide a mixture of a uniform air-fuel ratio and enabling the uniform distribution of the mixture into the respective cylinders of the respective engine combustion chambers. In addition, the carburetor according to this embodiment has no recourse to a heating technique for evaporting the fuel, thereby retaining a desired charging efficiency of the air-fuel mixture into the respective engine cylinders.

Still further, the size of the fuel particles thus atomized may be controlled by controlling the vibratory input of the vibratory member, so that if the vibratory input is maintained constant, then there may be achieved an atomized fuel having a relatively uniform particle size, as compared with those obtained from prior art carburetors and fuel injection means.

A fourth embodiment of the present invention is shown in FIG. 4, wherein the carburetor of this embodiment differs from those of the first to third embodiments in that the vibratory member 131, having the hollow cylindrical body structure and disposed in the fuel atomizing portion $III_4$, is disposed in the downstream portion of the intake passage $I_4$ which is horizontally disposed in the carburetor, the inner peripheral surface of the vibratory member 131 being in registry with the peripheral wall of the intake passage $I_4$.

The fuel supply portion $II_4$ of this embodiment adopts as SU type carburetor having a horizontal intake passage, and the intake barrel 411, serving as the intake passage $I_4$, is defined in the body 41 of the carburetor, a throttle valve 42 being positioned in the downstream portion thereof.

Positioned on the side wall of the body 41 of the carburetor and extending upwardly therefrom is a suction chamber 43 which houses therein an air piston 44 which is adapted to be slidably movable within the suction chamber 43 commensurate with a suction pressure or vacuum level prevailing within the carburetor. A plunger 45 is integrally formed in the lower portion of the air piston 44, and is adapted to vary the cross-sectional area of the venturi portion of the carburetor. Defined within the venturi portion is a jet orifice 47, within which is disposed a needle valve 46 one end of which is secured to the bottom portion of the punger 45, the vertical movements of the needle valve 46 thereby varying the fuel flow rate. An idling port 412 is defined in the side wall of the body 41 of the carburetor in the downstream portion of the intake barrel 411 for supplying fuel therethrough at the time no-load operation of the engine.

Positioned in the downstream portion of the intake barrel 411 of the carburetor, and downstream of the idling port 412, is the ultrasonic vibratory member 131 having a hollow cylindrical body and disposed in the ultrasonic-wave-generating body 130. The axis of the cylindrical body is in alignment with the axis of the intake barrel 411 and the inner peripheral surface of the vibratory member 131 is in registry with the peripheral wall of the intake barrel 411 in the carburetor. In this respect, the peripheral wall defining the aforenoted intake barrel 411 is coupled by means of two annular packing rings 48, to the annular wall of the aforenoted vibratory member 131, one surface 481 of each of the packing rings 48 being fitted within an annular shoulder portion 413 defined in the peripheral wall of the intake barrel 411 while the other surface 482 of each ring 48 is maintained in abutting relationship with respect to the annular end faces of the vibratory member 131 in such a manner as to sandwich the vibratory member 131 therebetween. In the ultrasonic-wave-generating body 130, the annular supporting plate 106 is externally disposed upon an annular seat 414 defined in the upper surface of the side wall portion of the body 41 of the carburetor, and is secured to the body 41 of the carburetor through means of a holding plate 111 and a plurality of screws 112.

The ultrasonic-wave-generating body 130 is equipped with an ultrasonic-vibration-amplifying block 132 of the exponential horn type, the vibratory member 131 being secured to the tip of the ultrasonic vibration amplifying block 132 with the wall of the member being secured to the aforenoted tip of the block 132 by means of a bolt 134 and a washer 133, the axis of the vibratory member 131 being maintained at a right angle with respect to the axis of the amplifying block 132. The construction other than that of the ultasonic-wave-generating body 130 is the same as that of the first embodiment and consequently, a detailed description of the same is omitted herefrom. Lead wires 113 are connected to the ultrasonic-wave-generating body 130 and the output side of the ultrasonic-wave oscillator 114, while the input side of the oscillator 114 is connected, by means of a vibratory-member-starting-switch 115, to an electric power source 116.

In the fuel atomizing portion $III_4$ of this embodiment, fuel which has been introduced from a float chamber, not shown, serving as a fuel supply source, through means of the idle port 412 and the jet orifice 47 into the intake barrel 411 in the carburetor, flows along the peripheral wall of the aforenoted intake barrel 411 and is supplied to the vibratory member 131 for atomization on the inner peripheral surface of the member 131 which generates ultrasonic vibrations. Accordingly, the function of the carburetor in this embodiment is identical to that of the third embodiment of the invention, exhibiting an excellent function of supplying an air-fuel mixture of a uniform air-fuel ratio, particularly during low and medium speed operation of the engine.

Stated otherwise, fuel which has been supplied through means of the jet orifice 47 and idling portion 412 and which flows without being atomized along the peripheral wall of the intake barrel 411, in clinging relation thereto is supplied to the vibratory member 313, having the hollow cylindrical body, for atomization thereof and thereby, so that only atomized fuel may be supplied to the respective engine cylinders and combustion chambers. This enables the uniform distribution of fuel into the respective cylinders to be achieved.

As a result of the vibratory member having the hollow cylindrical body structure, the atomizing area may be increased as compared with prior art carburetors, thus permitting instantaneous atomization of a great amount of fuel, and it is noted further that this embodiment is not intended to evaporate fuel according to a heating technique, and consequently, the same accomplishes a desired charging efficiency of an air-fuel mixture into the respective engine cylinders. The fourth embodiment also adopts a construction of a variable choke or SU type carburetor for the fuel supply portion $II_4$, and it is noted that the throttle valve 42 in FIG. 4 is not essential, it being possible to adopt a variable choke carburetor which does not have a throttle valve 42.

A description will now be given of the third asepct of the present invention by referring to the fifth to eighth embodiments of the present invention as shown in FIGS. 5 - 8.

According to the fifth embodiment of the ultrasonic wave carburetor, the ultrasonic vibratory member 101 is disposed within a fuel atomizing portion $III_5$ and is placed in the venturi portion of the intake passage $I_5$ and within the fuel supply portion $II_5$, with the axis of the cylindrical body being in alignment with the axis of the venturi 53 and with the inner peripheral surface of the member being in registry with and contiguous to the peripheral wall of the aforenoted venturi 53.

The fuel supply portion $II_5$ in this embodiment is that of a Carter type carburetor, and defined in the body 51 of the carburetor is an intake barrel 511 serving as an intake passage $I_5$, a choke valve 521 being disposed in the upper or upstream portion of the barrel 511, while a throttle valve 522 is disposed in the downstream portion of the barrel 511.

Positioned within the intake barrel 511 are a main venturi 51A and an internal venturi 53, and opening into the venturi 53 is an exit 542 of a main fuel nozzle 54 which is communicated, through means of a main fuel passage 541 and a fuel adjusting jet 55, with a float chamber 56 serving as a fuel supply source. The exit 542 of the main fuel nozzle 54 opens into the inner surface of the venturi 53, and shown at 57 is a fuel adjusting needle which is positioned in a main fuel supply system, while at 561 there is provided a float which is adapted to maintain the level of the fuel within the float chamber 56 at a constant predetermined height.

Positioned below, but contiguous with venturi 53, is an ultrasonic vibratory member 101 having a hollow cylindrical body structure, the axis of which is in alignment with the axis of the venturi 53, and the inner peripheral surface of which is in registry with and contiguous to the peripheral wall of the venturi 53.

In this embodiment, the venturi 53 is so designed as to admit fuel through the main fuel nozzle 54 under suction conditions and cause the fuel thus admitted to flow along the peripheral wall of the venturi 53 to the vibratory member 101 positioned thereunder. The inner diameter of the internal venturi 53 is substantially the same as the inner diameter of the vibratory member 101 and the annular end face 101A of the vibratory member 101 abuts the lower annular face 53A of the venturi 53.

The ultrasonic-wave-generating body is secured externally to a side wall of the intake barrel 511 of the body 51 of the carburetor in the same manner as that in the first embodiment, and the construction of the ultrasonic-wave-generating body and the other members is the same as that of the elements of the first embodiment, and consequently, a detailed description has been omitted herefrom. An acceleration fuel nozzle 58 protrudes into the intake barrel 511 in the carburetor, with one end thereof being open toward the upper end of the peripheral wall of the vibratory member 101, while the other end thereof is communicated by means of a discharge valve 581 and an acceleration fuel passage 582, with an acceleration pump 59.

In the operation of the fifth embodiment of the ultrasonic wave carburetor, when the vibratory-member-starting switch 115 is closed due to the starting operation of the internal combustion engine, an electrical oscillation is transmitted to the ultrasonic-wave-generating body by means of the ultrasonic wave oscillator 114, and then, the electrical oscillation is transformed into an ultrasonic vibration. The ultrasonic vibrations thus transformed and amplified in their amplitudes and are then transmitted to the ultrasonic vibratory member 101, having a hollow cylindrical body structure, in the ultrasonic-wave-generating body. Accordingly, the vibratory member 101 positioned contiguous to the downstream face of the cylindrical peripheral wall of the internal venturi 53 in the carburetor generates ultrasonic vibrations of large amplitude, as in the first embodiment, and more particularly, generates powerful ultrasonic waves from the vibratory surfaces of a large area, that is, the inner and outer peripheral surfaces thereof.

Air flows internally and externally of the internal venturi 53 due to suction or vacuum conditions prevailing in the internal combustion engine, and as a result, fuel within float chamber 56 is introduced, under such suction or vacuum conditions prevailing in the venturi portion, through means of the fuel adjusting jet 55, and main fuel passage 541, into the main fuel nozzle 54 from which the fuel is injected into the internal venturi 53 through means of the exit 542 of the nozzle 54. The fuel which has been introduced under suction conditions in this manner, but which has not been atomized, flows along the peripheral wall of the venturi in the form of a liquid and is supplied to the vibratory member 101. The fuel thus supplied is spread over the surfaces of the vibratory member 101, due to the ultrasonic vibrations generated thereby, so as to form liquid films thereon, and such films are in turn atomized into minute particles of fuel and scattered around and from the vibratory surfaces of the member 101.

In this embodiment then, fuel which has been introduced toward the main venturi may be instantaneously atomized due to the ultrasonic vibrations, and in addition, the fuel particles thus atomized may be thoroughly mixed with air, due to such powerful ultrasonic vibrations impressed upon the air streams, and which have been generated by means of the aforenoted vibratory member 101, and then supplied to a combustion chamber of an engine, such being carried by the air streams. Still further, when the acceleration pump 59 is operated during the time of a sudden acceleration of the engine, fuel injected through the acceleration nozzle 58 may be supplied to the outer peripheral surface of the vibratory member 101 for atomization, and consequently, the carburetor in this embodiment is well adapted for use in atomizing fuel during low, medium, and sudden acceleration operations of the engine.

The fifth embodiment is thus seen to present excellent functions and advantages of conserving fuel and minimizing the amount of unburned gases by supplying a mixture of a uniform air-fuel ratio into the respective cylinders of the engine, thereby enabling combustion of a lean air-fuel mixture. The carburetor according to the fifth embodiment enables the atomization of a great amount of fuel and may be operated over a broad range of operating conditions of the engine, extending from low speed to high speed operations, because of the inner and outer peripheral surfaces, of a large area, of the vibratory member 101 having the hollow cylindrical body thereof.

Yet further, according to this embodiment, fuel which has failed to be atomized in the venturi portion of the fuel supply portion $II_5$ is completely atomized in the fuel atomizing portion $III_5$, thereby enhancing the atomization of the fuel, and presenting remarkable atomizing effects and a mixture of a uniform air fuel ratio, as compared with prior art carburetors. This then enables the uniform distribution of such an air-fuel mixture into the respective cylinders of the engine.

Still further, the carburetor of this embodiment has no recourse to a heating technique for evaporating the fuel, thus permitting the retention of a desired charging efficiency of an air-fuel mixture into the respective engine cylinders. Furthermore, the carburetor of this embodiment may control the vibratory-input to the vibratory member so as to control the size of the fuel particles to be atomized, and thus may maintain the size of the fuel particles to be uniform by maintaining the vibratory-input constant.

The specification will now continue with a description of the sixth embodiment of the present invention as shown in FIG. 6. The feature of the sixth embodiment differs from the fifth embodiment in that the nozzle used in the fifth embodiment is replaced by a plurality of fuel injection ports within the internal venturi in the fuel supply portion $II_6$, whereby the fuel which has been admited under suction conditions through the aforenoted injection ports is supplied along the nodes of flexural vibration of the vibratory member, having the hollow cylindrical body structure, in the fuel atomizing portion $III_6$, as shown in FIG. 1(c), the inner peripheral surface of the vibratory member being in registry with and contiguous to the peripheral wall of the internal venturi.

The construction of the fuel supply portion $II_6$ in this embodiment is that of a Weber type carburetor, and includes an intake barrel 611 serving as an intake passage $I_6$ defined in a body 61 of the carburetor, a choke valve 621 positioned in the upstream portion of the intake barrel 611, and a throttle valve 622 positioned in the downstream portion of the barrel 611. A main venturi 61A and an internal venturi 63 are also positioned within the intake barrel 611.

The internal venturi 63 is defined by means of an inner ring 631 and an outer ring 632, the outer ring 632 being secured, by means of two arms 632A provided on the outer side wall thereof, to the body 61 of the carburetor. Running through one of the arms 632A is a fuel-communicating passage 632B which is communicated, through means of a main fuel passage 64 in the carburetor body 61, an air bleed chamber 65, and a main fuel jet 66, with a float chamber 67 serving as a fuel supply source. An annular groove 631A is also defined around the outer peripheral surface of the inner ring 631 in communicating relationship with the aforenoted fuel communicating passage 632B, and the inner ring 631 is integrally fitted upon the inner peripheral surface of the outer ring 632.

Positioned contiguous to and under the internal venturi 63 is an ultrasonic vibratory member 141, having a hollow cylindrical body structure, which is part of an ultrasonic wave generating body 140, the axis of the cylindrical body being in alignment with the axis of the internal venturi 63, while the inner peripheral surface of the vibratory member 141 is in registry with and contiguous to the peripheral wall of the internal venturi 63, and in this respect, the upper annular face of the vibratory member 141 abuts the bottom annular face of the internal venturi 63. Opening from the inner peripheral surface of the inner ring 631 and within the venturi 63 are a plurality of fuel injection ports 631B which are communicated with the annular groove 631A and are positioned equiangularly about the circumference thereof. In addition, the positions of the injection ports are so designed as to be in vertical alignment with the positions of the plurality of vibrational nodes when the vibratory member 141 generates flexural vibrations as shown in FIG. 1(c), and as a result, fuel, which has been introduced under suction conditions through the injection ports 631B, is supplied to the vibrational nodes upon the vibratory member 141 along the wall of the internal venturi 63. The construction of the other members and ultrasonic wave generating body are the same as those given in the fifth embodiment and therefore, a detailed description thereof is omitted herefrom.

In operation of the carburetor of the sixth embodiment of the present invention, the function of the carburetor of this embodiment is essentially the same as that of the fifth embodiment, except for the method for supplying the fuel to the vibratory member. Thus, the description will concentrate on this essential part of the function of the carburetor.

When air is caused to flow internally and externally of the internal venturi 63 due to the suction or vacuum conditions prevailing in the internal combustion engine, then fuel within the float chamber 67 is directed, under the vacuum conditions prevailing in the venturi portion, through the main fuel jet 66, air bleed chamber 65, main fuel passage 64, fuel-communicating passage 632B, annular groove 631A, and the plurality of fuel injection ports 631 into the internal venturi 63 along the inner peripheral surface thereof. A plurality of fuel streams thus introduced under suction conditions flow downwardly along the inner peripheral surface of the internal venturi so as to be supplied to the plurality of vibrational nodes on the vibratory member 141. The fuel supplied to the vibrational nodes is then attracted to the vibratory surfaces, which define the periphery of the vibratory member 141, due to the ultrasonic vibration thereof, so as to thereby form liquid films on the vibratory surfaces, the liquid films then being atomized into minute particles of fuel and scattered around and from the vibratory surfaces of the vibratory member 141.

According to the ultrasonic-wave carburetor of this embodiment, fuel which has been introduced under suction conditions to the venturi portion of the carburetor may be uniformly supplied to the entire periphery of the vibratory member 141 so that the entire inner peripheral surface thereof may be used as an effective atomizing surface, thus enabling atomization of a great amount of fuel in a consistent manner. Thus, the carburetor of this embodiment may supply an air-fuel mixture of a uniform air-fuel ratio to the engine, thus permitting combustion of a lean mixture and preventing production of harmful unburned gases, and conserving fuel.

The third aspect of the present invention will be described in conjunction with the seventh embodiment shown in FIG. 7, wherein the carburetor features an internal venturi 71 disposed in a fuel supply portion $II_7$ and which is of increased size as compared with the internal venturi of the sixth embodiment, and a small venturi 72 provided within the internal venturi 71, a large-size vibratory member 151 being positioned, with its inner peripheral surface in registry with and contiguous to the peripheral wall of the internal venturi, in a fuel atomizing portion $III_7$, thereby enabling atomization of a great amount of fuel per unit of time.

An intake barrel 611, serving as an intake passage $I_7$, is defined in a body 61 of the carburetor, while a choke valve 621 is positioned in the upstream portion of the barrel 611 and a throttle valve 622 is positioned in the downstream portion of the barrel 611. Positioned within the intake barrel 611 is a main venturi 613 having a slightly throttled wall portion, while a large-size internal venturi 71 is positioned about the main venturi 613. The internal venturi 71 consists of an inner ring 711 and an outer ring 712, as in the sixth embodiment, the outer ring 712 being secured to the body 61 of the carburetor by means of two arms 712A integral with the outer surface of the outer ring 712.

Defined through one of the arms 712A is a fuel-communicating passage 712B which is communicated, through means of a main fuel passage 64, air bleed chamber 65, and a main fuel jet 66, with a float chamber, not shown, serving as a fuel supply source, and defined in the outer periphery of the inner ring 711 is an annular groove 711A which is communicated with the fuel-communicating passage 712B, the aforenoted inner ring 711 being integrally secured upon the inner peripheral surface of the outer ring 712.

The small venturi 72 is positioned in the central portion of the internal venturi 71, and the small venturi 72 insures the fact that the air streams have a sufficient flow speed when flowing through the internal venturi 71, venturi 72 being secured to the inner surface of the internal venturi 71 by means of two arms, not shown. Positioned under the internal venturi 71 is a large-size vibratory member 151, having a hollow cylindrical body structure, which is part of an ultrasonic-wave-generating body 150, the axis of the vibratory member 151 being in alignment with the axis of the internal venturi 71 while the inner peripheral surface of the member 151 is in registry with and contiguous to the peripheral wall of the aforenoted venturi 71, whereby the upper annular face 151A of the member 151 abuts the bottom annular face 71A of the venturi 71.

Openings from the inner peripheral surface of the inner ring 711 and within the internal venturi 71 are a plurality of fuel injection ports 711B which are communicated with the annular groove 711A and are positioned equiangularly about the circumference thereof. The positions of the fuel injection ports 711B are so designed as to be in vertical alignment with the positions of nodes of the flexural vibration of the vibratory member 151 as shown in FIG. 1(c), and in addition, the construction of the other members of this embodiment and the ultrasonic wave generating body are the same as those of the preceding embodiments.

Accordingly, in this embodiment, as in the sixth embodiment, fuel which has been introduced under suction conditions, through the injection ports 711B, is supplied to the vibrational nodes on the large-size vibratory member 151, so that a great amount of fuel may be atomized in a consistent manner. In addition, the ultrasonic wave carburetor in this embodiment uses a large-size vibratory member so as to thereby have a capability of atomizing a great amount of fuel per unit of time, and thus finds an application in a large-size engine, as well, while presenting excellent advantages for operation of the engine as in the preceding embodiments.

A description will now be given of the eighth embodiment of the present invention as shown in FIG. 8. The ultrasonic wave carburetor according to this embodiment features an ultrasonic vibratory member 161, having a hollow cylindrical body structure, disposed in a fuel atomizing portion $III_8$ and placed in such a manner that the inner peripheral surface of the member 161 is in registry with and contiguous to the peripheral wall of a main venturi 81 disposed in a fuel supply portion $II_8$, as in the fifth to seventh embodiments. In this case, the ultrasonic vibratory member 161 is of a larger size than that used in the seventh embodiment.

An intake barrel 611, serving as an intake passage $I_8$, is defined in a body 61 of the carburetor, while a choke valve 621 is positioned in the upstream portion of the barrel 611 and a throttle valve 622 is positioned in the downstream portion of the barrel 611. Positioned within the intake barrel 611 is the main venturi 81 which consists of an annular member with an annular groove 81A defined in the outer periphery thereof. The main venturi 81 is disposed in the peripheral wall of the intake barrel 611 in the carburetor in such a manner that the annular groove 81A is communicated, through means of a main fuel passage 64, air bleed 65, and a main fuel jet 66, which are provided in the body 61 of the carburetor, with a float chamber, not shown, serving as a fuel supply source.

A small venturi 82 is positioned in the central portion of the main venturi 81 so as to insure the fact that the air streams have a sufficient flow speed when flowing through the main venturi 81, and the same is secured to the inner surface of the main venturi 81 by means of two arms, not shown. Beneath the main venturi 81, there is disposed a vibratory member 161, having a hollow cylindrical body structure, which is larger than that used in the seventh embodiment, in such a manner that the axis of the vibratory member 161 is in alignment with the axis of the main venturi 81 and the inner peripheral surface of the member 161 is in registry with and contiguous to the peripheral wall of the aforenoted main venturi 81, the upper annular face 161A of the member 161 abutting the bottom annular end face 811A of the lower annular projection 811 of the main venturi 81. Opening from the inner peripheral surface of the main venturi 81 are a plurality of fuel injection ports 81B which are in communication with the annular groove 81A and are positioned equiangularly about the circumference thereof, the positions of the fuel injection ports 81B being such as to be in vertical alignment with the positions of nodes of the flexural vibration of the vibratory member 161 as shown in FIG. 1(c).

Accordingly, in this embodiment, as in the seventh embodiment, fuel which has been introduced under suction conditions through the injection ports 81B is supplied to the vibrational nodes on the large size vibratory member 161, so that a great amount of fuel may be atomized. In addition, the ultrasonic wave carburetor in this embodiment finds an application in a larger size engine, as well, while presenting excellent advantages for operating the engine as in the preceding embodiment.

Figure 11:
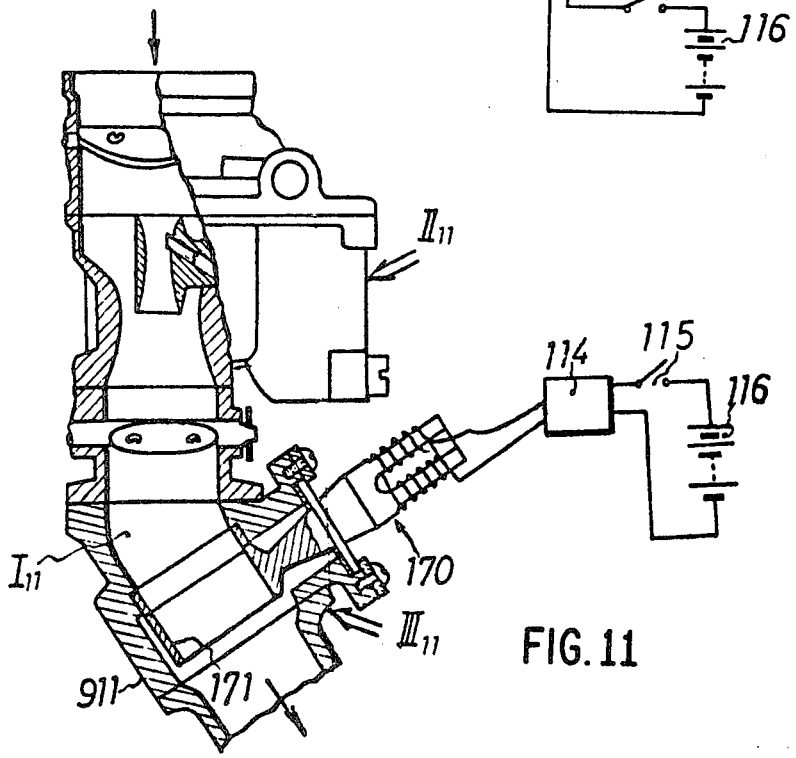
FIG. 11 is a schematic, elevation view, partly in cross-section, of the eleventh embodiment of the carburetor according to the present invention.
Figure 9:
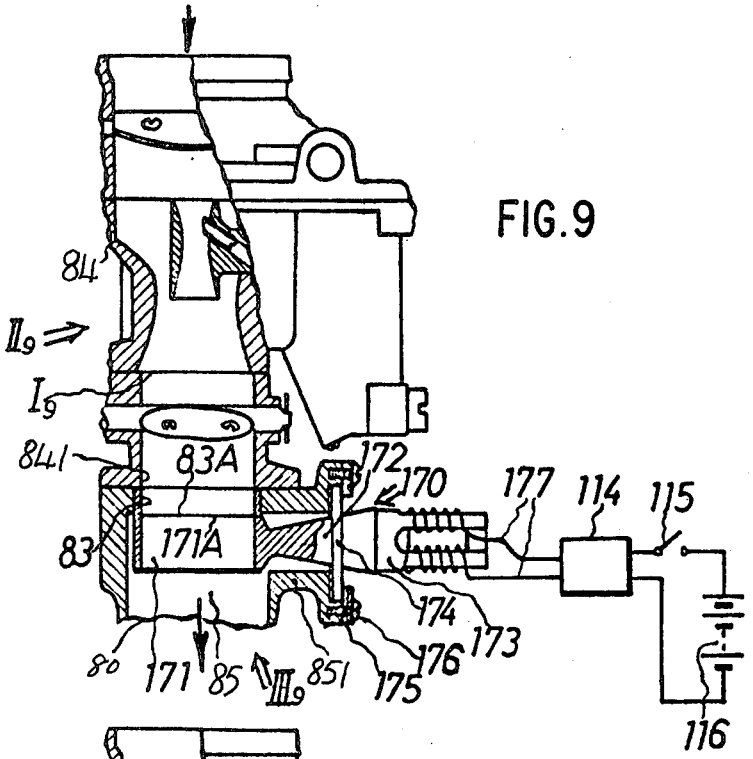
FIG. 9 is a schematic, elevation view, partly in cross-section, of the ninth embodiment of the carburetor.
Figure 10:
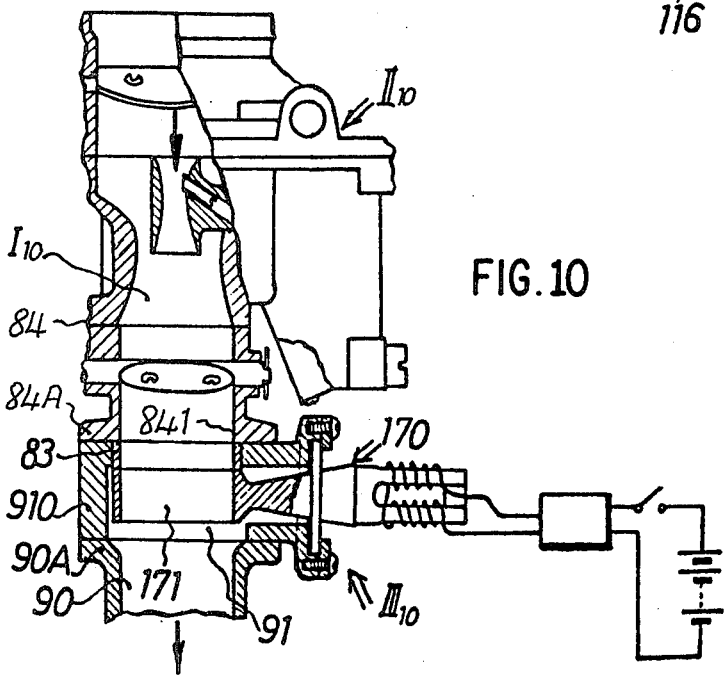
FIG. 10 is a schematic, elevation view, partly in cross-section of the tenth embodiment of the carburetor.

The fourth aspect of the present invention will now be described by reference to the ninth to eleventh embodiments as shown in FIGS. 9 to 11.

Unlike the first to third aspects of the present invention, the carburetor of the ninth embodiment features an ultrasonic vibratory member 171, having a hollow cylindrical body structure, disposed in a fuel atomizing portion $III_9$ and placed within an intake manifold 80 at a position spaced a predetermined distance from the venturi and downstream of the throttle plate within the intake passage $I_9$, with the axis of the member 171 being in alignment with the axis of the intake manifold 80, and with the inner peripheral surface of the vibratory member 171 being in registry with the exit peripheral wall 841 of the intake passage $I_9$ which is in communication with the intake manifold 80. According to the ultrasonic wave carburetor of this embodiment, atomization is carried out at a position close to the engine combustion chamber, unlike the preceding embodiments, so that there results a decrease in the travelling distance of the atomized fuel, and the intake pipe may be heated by the heat from the engine, thereby presenting advantages in that the atomized fuel does not cling to the peripheral wall of the intake passage, and an ordinaly type carburetor may be used as the fuel supply portion $II_9$ without modification.

Defined in the upper end of the intake manifold 80 is a fuel atomizing chamber 85 and a seat 851 is formed on the external wall of the fuel atomizing chamber 85 for securing an ultrasonic wave generating body 170 thereto. Disposed within the fuel atomizing chamber 85 is an ultrasonic vibratory member 171 of the ultrasonic wave generating body 170, with the axis of the vibratory member 171, having a hollow cylindrical body structure, being in alignment with the axis of the intake manifold 80, the inner peripheral surface of the vibratory member 171 also being in registry with the exit peripheral wall 841 of the intake barrel serving as an intake passage $I_9$ in the body 84 of the carburetor.

In this respect, the peripheral wall 841 of the intake passage in the carburetor is coupled through the medium of an annular ring 83 to the peripheral wall of the vibratory member 171, the aforenoted annular ring 83 being disposed in the entrance to the intake barrel in the feul atomizing chamber 85. The bottom annular end face 83A of the annular ring 83 abuts the top annular end face 171A of the vibratory member 171, it being noted, however, that the inner diameter of the exit peripheral wall 841 of the intake barrel, the inner diameter of the annular ring 83, and the inner diameter of the vibratory member 171 are substantially the same.

The ultrasonic wave generating body 170, including the ultrasonic vibratory member 171, is formed with an ultrasonic wave amplifying block 172 of a frustoconical horn type, while the vibratory member 171 is integrally formed upon the end face of the small diameter portion of the block 172, a magnetostrictive ultrasonic wave transducer 173 being secured to the other end face of the large diameter portion of the block 172. The ultrasonic wave generating body 170 has a supporting plate 174 disposed at a position where vertical vibrations are nullified, that is, a position of a vibrational node, and the supporting plate 174 is secured by means of a holding plate 175 to the intake manifold 80 by means of a plurality of screws 176, with the supporting plate 174 being disposed within a seat 851 of the aforenoted atomizing chamber 85. In addition, a lead wire 177 is wound around the magnetostrictive ultrasonic wave transducer 173 for a predetermined number of windings, and is connected to the output side of an ultrasonic wave oscillator 114 for generating ultrasonic waves, while the input side of the ultrasonic wave oscillator 114 is connected by means of a vibratory-member-starting switch 115 to an electric power source 116.

A description will now be given of the operation of the ninth embodiment. When the vibratory-member-starting-switch 115 is closed due to the starting operation of the internal combustion engine, an electrical oscillation is transmitted from the ultrasonic wave oscillator 114 to the magnetostrictive ultrasonic wave transducer 173 so as to be transformed into an ultrasonic vibration. The ultrasonic vibrations thus produced are amplified in their amplitude by means of the ultrasonic-wave-vibration-amplifying block 172 and then transmitted to the ultrasonic vibratory member 171. Thus, the vibratory member 171 positioned within the fuel atomizing chamber 85 of the intake manifold 80 generates ultrasonic vibrations of a large amplitude as shown in FIG. 1(c), thereby providing powerful ultrasonic waves on its vibratory surfaces of large area, that is, the peripheral surfaces of the vibratory member 171.

Fuel, which flows in the form of a liquid along the peripheral wall of the intake barrel in the carburetor due to insufficient atomization of the fuel in the charburetor, particularly during low and medium speed operation of the engine, is supplied from the peripheral wall 841 at the exit of the intake barrel in the carburetor and along the inner peripheral surface of the annular ring 83 to the inner peripheral surface of the vibratory member 171 for atomization thereby.

The ultrasonic wave carburetor according to this embodiment may thus provide excellent functions and advantages for operation of an engine as in the third and fourth embodiments, or in other words, the carburetor according to this embodiment may supply atomized fuel to all of the combustion chambers of the engine without causing the atomized fuel to cling to the peripheral wall of the intake barrel and will also supply air-fuel mixture of a uniform air-fuel ratio to the engine, thereby enabling combustion of a lean mixture, preventing production of harmful unburned gases, and conserving fuel.

The carburetor of this embodiment may provide advantages other than those described above, as in the preceding embodiments, and may be used as a fuel supply means $II_9$ without modifying prior art carburetors for use in an internal combustion engine.

Furthermore, the fourth aspect of the present invention may be modified as shown in FIG. 10, wherein this embodiment unlike the ninth embodiment, features the fuel atomizing chamber 91 being independent of the intake manifold 90. Stated otherwise, the fuel atomizing chamber 91 is placed within a tubular member 910 which is independent of the fuel supply portion $II_{10}$ and the intake manifold. The tubular member 910 is interposed between a securing flange 84A of the body 84 of the carburetor and an attaching flange 90A of the intake manifold 90 by fastening means, such a bolts. The remaining construction of the embodiment is the same as that of the ninth embodiment.

The inner diameter of the peripheral wall of the intake barrel in the carburetor, and at the exit thereof, the inner diameter of the annular ring 83, and the inner diameter of the ultrasonic vibratory member 171 which is secured to the outer wall of the tubular member 910 and defines the fuel atomizing chamber 91, are substantially the same. As a result, fuel which flows along the peripheral wall 841 of the intake barrel flows along the inner peripheral surface of the annular ring 83 to the inner peripheral surface of the vibratory member 171 for complete atomization on the vibratory surfaces of the member 171, thus providing an advantage in that atomized fuel may be supplied to all of the combustion chambers of the engine without causing fuel to cling to the peripheral wall of the intake barrel.

Furthermore, the fourth aspect of the invention may be further modified as shown in FIG. 11. Unlike the preceding embodiments, the intake barrel $I_{11}$ is bent in the downstream portion of the intake passage in the carburetor, and a fuel atomizing chamber 911, provided within the fuel atomizing portion $III_{11}$, is positioned in the vicinity of the aforenoted bent portion of the intake barrel.

According to this embodiment, atomized fuel, which has been injected through a fuel nozzle in the fuel supply portion $II_{11}$, impinges on the peripheral wall of the bent portion of the intake barrel, while fuel in the form of liquid flowing along the peripheral wall of the barrel is supplied to the ultrasonic vibratory member 171 in the ultrasonic wave generating body 170 for complete atomization due to the ultrasonic vibrations thereof.

Accordingly, the carburetor of this embodiment may supply atomized fuel to all of the combustion chambers, without causing fuel to cling to the peripheral wall of the intake barrel, and presents improved atomization of fuel without loss, as compared with the ninth and tenth embodiments. The carburetor of this embodiment may thus supply an air-fuel mixture of a uniform air-fuel ratio to the engine, thereby enabling combustion of a lean mixture, prevention of the production of unburned gases, and conservation or fuel.

The description has been thus far given of the use of piezoelectric elements and the use of a magentostrictive element as the ultrasonic wave transducer in the ultrasonic wave generating portion of the apparatus, however, the present invention should not be construed in a limited sense but may be modified or altered within the scope of the invention. In addition, the embodiments using piezoelectric elements and magnetostrictive elements are only given for illustrative purposes, and various modifications are of course possible.

The ultrasonic vibration amplifying portion has been described by referring to a stepped type horn, an exponential type horn, and a conical type horn, however, the present invention is not limited to those examples, and thus, any type horn may be used, so long as the mechanical vibrations are able to be amplified thereby. For instance, Fourier type and catenary type horns, and/or others may be used.

In addition, the description has been given of a vibratory member by referring to a hollow cylindrical body structure. However, the present invention is by no means limited to this example, any hollow cylindrical body of small wall thickness, that is, of an elliptical cross-section, a polygonal cross-section, and a non-uniform wall thickness may be used. In addition, a rectangular thin plate of a given dimension may be bent so as to obtain a cylindrical portion and a joint portion, and the joint portion may be integrally secured to the tip of the ultrasonic vibration amplifying portion, such as by welding and the like. Also, a part of the peripheral wall of the cylindrical body opposed to such joint portion may be open. Still further, the present invention is not limited to an intake passage, part of which is bent, nor to an angle of a passage thus bent.

In summary, the ultrasonic wave carburetor constructed according to the present invention comprises an intake passage for admitting fresh air and supplying an air-fuel mixture therethrough; a fuel supply portion consisting of a reservoir which reserves fuel therein, a venturi provided in the intake passage, and a nozzle one end of which is open into the venturi and the other end of which is communicated with a float chamber; and a fuel atomizing portion consisting of an ultrasonic transducing portion connected to an ultrasonic wave oscillator for transforming an electrical oscillation into a mechanical vibration, a mechanical vibration amplifying portion secured to the ultrasonic transducing portion and amplifying the mechanical vibrations, and an ultrasonic vibratory member, having a hollow cylindrical body structure which is positioned downstream of the venturi in the intake passage, with its outer peripheral surface integrally secured to the mechanical vibration amplifying member.

According to the ultrasonic wave carburetor of the present invention, liquid fuel, which has been metered commensurate with the flow rate of the air streams being admitted through an intake passage, is supplied to the ultrasonic vibratory member, the fuel thus supplied is instantaneously atomized due to the ultrasonic vibrations of the vibratory member, and the atomized fuel is then thoroughly mixed with air due to the powerful ultrasonic vibrations generated in the air within the intake passage by means of the vibratory member so as to promote atomization of the fuel so as to thereby provide an air-fuel mixture of a uniform air-fuel ratio for a combustion chamber of the engine.

It will be understood that the above description is merely illustrative of preferred embodiments of the invention. Additional modifications and improvements utilizing the discoveries of the present invention can be readily anticipated by those skilled in the art from the present disclosure, and such modification and improvements may fairly be presumed to be within the scope of the present invention as defined by the appended claims.

What is claimed as new and desired to be secured by letters patents of the United States is:

1. An ultrasonic wave carburetor comprising:

an intake passage for admitting fresh air and supplying an air-fuel mixture therethrough;

a fuel supply device comprising a reservoir which reserves fuel therein, a venturi provided in said intake passage, and a nozzle, one end of which opens into said venturi and the other end of which is communicated with said reservoir; and a fuel atomizing device comprising an ultrasonic transducer connected to an ultrasonic wave oscillator for transforming an electrical oscillation into a mechanical vibration, a mechanical vibration amplifying member secured to said ultrasonic transducer for amplifying said mechanical vibrations, and an ultrasonic vibratory member, having a hollow cylindrical body, which is positioned downstream of said venturi within said intake passage, with its outer peripheral surface integrally secured to said mechanical vibration amplifying member, whereby fuel supplied through said nozzle in said fuel supplying device is atomized upon the peripheral surfaces of said hollow cylindrical body of said ultrasonic vibratory member which is being vibrated.

2. An ultrasonic wave carburetor according to claim 1, wherein:

said ultrasonic vibratory member is provided downstream of said nozzle in said fuel supply device, and the axis of said ultrasonic vibratory member is inclined at a predetermined angle with respect to the axis of said venturi provided in said intake passage.

3. An ultrasonic wave carburetor according to claim 1, wherein:

the inner peripheral surface of said ultrasonic vibratory member is aligned with the peripheral wall of said intake passage.

4. An ultrasonic wave carburetor according to claim 1, wherein:

said ultrasonic vibratory member is aligned with the peripheral side wall of said venturi so as to be coaxial with said venturi.

5. An ultrasonic wave carburetor according to claim 1, wherein:

said ultrasonic vibratory member is disposed downstream of a throttle plate and at a predetermined distance from said venturi in said intake passage; and the inner peripheral surface of said hollow cylindrical body is aligned with the peripheral wall of said intake passage.

6. An ultrasonic wave carburetor according to claim 1, wherein:

said fuel supply device comprises a device selected from the group consisting of fuel supply devices of a Solex type carburetor, a Zenith type carburetor, a Weber type carburetor, a Carter type carburetor, and an SU type carburetor.

7. An ultrasonic wave carburetor according to claim 1, wherein:

said ulatrasonic transducer in said fuel atomizing device comprises a transducer selected from the group consisting of a piezoelectric type ultrasonic transducer, and a magnetostrictive type ultrasoinc transducer.

8. An ultrasonic wave carburetor according to claim 1, wherein:

said mechanical vibration amplifying member in said fuel atomizing device comprises a member selected from the group consisting of a stepped type horn, an exponential type horn, a conical type horn, a Fourier type horn, and a catenary type horn.

9. An ultrasonic wave carburetor according to claim 1, wherein:

said hollow cylindrical body of said vibratory member in said fuel atomizing device comprises a body selected from the group consisting of a hollow cylinder, a hollow cylindrical member having an elliptical cross-section, a hollow cylindrical member having a polygonal cross-section, a hollow cylindrical member having a non-uniform wall thickness, and a hollow cylindrical member comprising a bent rectangular member and a welded thin plate of predetermined dimensions.

10. An ultrasonic wave carburetor according to claim 2, wherein:

said hollow cylindrical member is disposed directly beneath said venturi in said intake passage; and the axis of said hollow cylindrical member is inclined at an angle of 45° with respect to the axis of said venturi.

11. An ultrasonic wave carburetor according to claim 10, wherein:

said fuel supply device comprises a fuel supply device of a Zenith type carburetor;

said hollow cylindrical member comprises a hollow cylinder;

said mechanical vibration amplifying member comprises a stepped type horn; and said ultrasonic transducer comprises a piezoelectric type transducer.

12. An ultrasonic wave carburetor according to claim 2, wherein:

said hollow cylindrical member is provided upon a bent portion of said carburetor and is interposed between said venturi and a throttle valve in said intake passage, the axis of said hollow cylindrical member being inclined at an angle of 45° with respect to the axis of said venturi.

13. An ultrasonic wave carburetor according to claim 12, wherein:

said hollow cylindrical member comprises a hollow cylinder;

said mechanical vibration amplifying member comprises a stepped type horn; and said ultrasonic transducer comprises a piezoelectric type transducer.

14. An ultrasonic wave carburetor according to claim 3, wherein:

said hollow cylindrical member is provided downstream of a throttle valve in said intake passage.

15. An ultrasonic wave carburetor according to claim 14, wherein:

said fuel supply device comprises a Solex type carburetor;

said hollow cylindrical member comprises a hollow cylinder;

said mechanical vibration amplifying member comprises a conical type horn; and said ultrasonic transducer comprises a piezoelectric type transducer.

16. An ultrasonic wave carburetor according to claim 3, wherein:

said intake passage is horizontally disposed; and said hollow cylindrical member is provided downstream of a throttle valve in said horizontally disposed intake passage.

17. An ultrasonic wave carburetor according to claim 16, wherein:

said fuel supply device comprises an SU type carburetor;

said hollow cylindrical member comprises a hollow cylinder;

said mechanical vibration amplifying member comprises an exponential type horn; and said ultrasonic transducer comprises a piezoelectric type transducer.

18. An ultrasonic wave carburetor according to claim 4, wherein:

said hollow cylindrical member is aligned with an inner venturi which is disposed upstream of a main venturi provided in said intake passage.

19. An ultrasonic wave carburetor according to claim 18, wherein:

said fuel supply device comprises a Carter type carburetor;

said hollow cylindrical member comprises a hollow cylinder;

said mechanical vibration amplifying member comprises a stepped type horn; and said ultrasonic transducer comprises a piezoelectric type transducer.

20. An ultrasonic wave carburetor according to claim 18, wherein:

said fuel supply device comprises a Weber type carburetor of which said inner venturi has a plurality of injection ports connected to said reservoir and which ports open on the inner peripheral surface thereof;

said hollow cylindrical member comprises a hollow cylinder;

said mechanical vibration amplifying member comprises a conical type horn; and said ultrasonic transducer comprises a piezoelectric type transducer.

21. An ultrasonic wave carburetor accoding to claim 4, wherein:

said hollow cylindrical member is provided at an axial position corresponding to the disposition of a main venturi formed upon the wall forming said intake passage and aligned with an inner ring of an inner venturi;

said inner venturi comprises said inner ring and an outer ring secured to the wall of said intake passage, and having a small venturi coaxially provided therein; and said inner ring of said inner venturi and said small venturi are integrally formed and have varied radial thicknesses in the axial direction thereof.

22. An ultrasonic wave carburetor according to claim 21, wherein:

said fuel supply device comprises a Weber type carburetor of which said inner ring of said inner venturi has a plurality of injection ports connected to said reservoir and opening on the inner peripheral surface thereof;

said hollow cylindrical member comprises a hollow cylinder;

said mechanical vibration amplifying member comprises a stepped type horn; and said ultrasonic transducer comprises a piezoelectric type transducer.

23. An ultrasonic wave carburetor according to claim 4, wherein:

said hollow cylindrical member is aligned with a main venturi comprising an annular member and which is disposed within a stepped portion of said wall forming said intake passage; and said main venturi has small venturi disposed therein and integrally formed therewith at the central portion thereof.

24. An ultrasonic wave carburetor according to claim 23, wherein:

said fuel supply device comprises a Weber type carburetor of which said main venturi has a plurality of injection ports connected to said reservoir and opening on the inner peripheral surface thereof;

said hollow cylindrical member comprises a hollow cylinder;

said mechanical vibration amplifying member comprises a stepped type horn; and said ultrasonic transducer comprises a piezoelectric type transducer.

25. An ultrasonic wave carburetor according to claim 5, wherein:

said hollow cylindrical member is disposed coaxially with said intake passage and downstream of a throttle plate disposed in said intake passage.

26. An ultrasonic wave carburetor according to claim 25, wherein:

said hollow cylindrical member comprises a hollow cylinder;

said mechanical vibration amplifying member comprises a conical type horn; and said ultrasonic transducer comprises a magnetostrictive type transducer.

27. An ultrasonic wave carburetor according to claim 5, wherein:

said hollow cylindrical member is disposed within an annular member which is interposed between said fuel supply device and an intake manifold connected to an internal combustion engine, downstream of a throttle plate disposed in said intake passage, and is coaxial with respect to said intake passage which is partly formed within said annular member.

28. An ultrasonic wave carburetor according to claim 27, wherein:

said hollow cylindrical member comprises a hollow cylinder;

said mechanical vibration amplifying member comprises a conical type horn; and said ultrasonic transducer comprises a magnetostrictive type transducer.

29. An ultrasonic wave carburetor according to claim 5, wherein:

said hollow cylindrical member is disposed within an annular member, which forms a bent portion of said intake passage and which is interposed between said fuel supply device and an intake manifold connected to an internal combustion engine, so as to be disposed downstream of a throttle plate disposed in said intake passage; and said hollow cylindrical member is coaxial with said intake passage which is partly formed within said annular member.

30. An ultrasonic wave carburetor according to claim 29, wherein:

said hollow cylindrical member comprises a hollow cylinder;

said mechanical vibration amplifying member comprises a conical type horn; and said ultrasonic transducer comprises a magnetostrictive type transducer.

31. An ultrasonic wave carburetor according to claim 11, wherein:

said hollow cylinder is disposed at an axial positoin corresponding to the rear half of a main venturi provided upon the wall forming said intake passage, by fitting a flange portion of said stepped type horn and a flange portion of a backing block, having piezoelectric elements disposed therebetween and fastened together by a plurality of bolts, to a seat portion provided upon the outer wall of a carburetor body through means of an annular supporting plate, a holding plate, fitted to said annular supporting plate, being secured to said outer wall by a plurality of screws; and said piezoelectric elements are connected to said ultrasonic wave oscillator and an energy source by lead wires.

32. An ultrasonic wave carburetor according to claim 13, wherein:

said hollow cylinder is disposed within said intake passage by fitting a flange portion of said stepped type horn and a flange portion of a backing block, having piezoelectric elements therebetween and fastened together by a plurality of bolts, to a seat portion provided upon the outer wall of a carburetor body through means of an annular supporting plate, a holding plate, fitted to said annular supporting plate, being secured to said outer wall by a plurality of screws; and said piezoelectric elements are connected to said ultrasonic wave oscillator and an energy source by lead wires.

33. An ultrasonic wave carburetor according to claim 15, wherein:

said hollow cylinder is aligned with said intake passage through means of an annular ring at a position downstream of an idle port of said Solex type carburetor, by fitting a flange portion of said conical type horn and a flange portion of a backing block, having piezoelectric elements disposed therebetween and fastened together by a plurality of bolts, to a seat portion provided upon a projecting outer wall of a carburetor body through means of an annular supporting plate, a holding plate, fitted to said annular supporting plate, being secured to said projecting outer wall by a plurality of screws; and said piezoelectric elements are connected to said ultrasonic wave oscillator and an energy source by lead wires.

34. An ultrasonic wave carburetor according to claim 17, wherein:

said hollow cylinder is secured to the output end of said exponential type horn by means of a bolt, and is aligned with said intake passage through means of two annular rings disposed within a stepped portion provided upon the wall forming said intake passage at a position downstream of an idle port opening into said intake passage, by fitting a flange portion of said exponential type horn and a flange portion of a backing block, having piezoelectric elements disposed therebetween and fastened together by a plurality of bolts, to a seat portion provided upon a projecting outer wall of a carburetor body through means of an annular supporting plate, a holding plate, fitted to said annular supporting plate, being secured to said projecting outer wall by a plurality of screws; and said piezoelectric elements are connected to said ultrasoinc wave oscillator and an energy source by lead wires.

35. An ultrasonic wave carburetor according to claim 19, wherein:

said hollow cylinder has the same outer diameter as that of said inner venturi, and is provided in said intake passage, by fitting a flange portion of said stepped type horn and a flange portion of a backing block, having piezoelectric elements disposed therebetween and fastened together by a plurality of bolts, to a seat portion provided upon the outer wall of said carburetor through means of an annular supporting plate, a holding plate, fitted to said annular supporting plate, being secured to said outer wall by a plurality of screws; and said piezoelectric elements are connected to said ultrasonic wave oscillator and an energy source by lead wires.

36. An ultrasonic wave carburetor according to claim 20, wherein:

said hollow cylinder is aligned with said inner venturi, by fitting a flange portion of said conical type horn and a flange portion of a backing block having piezoelectric elements disposed therebetween and fastened together by a plurality of bolts, to a seat portion provided on the outer wall of a carburetor body through means of an annular supporting plate, a holding plate, fitted to said annular supporting plate being secured to said outer wall by a plurality of screws; and said piezoelectric elements are connected to said ultrasonic wave oscillator and an energy source by lead wires.

37. An ultrasonic wave carburetor according to claim 22, wherein:

said hollow cylinder is aligned with said inner ring of said inner venturi, by fitting a flange portion of said stepped type horn and a flange portion of a backing block, having piezoelectric elements disposed therebetween and fastened together by a plurality of bolts, to a seat portion provided on the outer wall of a carburetor body through means of an annular supporting plate, a holding plate, fitted to said annular supporting plate, being secured to said outer wall by a plurality of screws; and said piezoelectric elements are connected said to ultrasonic wave oscillator and an energy source by lead wires.

38. An ultrasonic wave carburetor according to claim 24, wherein:

said hollow cylinder is alinged with said main venturi, by fitting a flange portion of said stepped type horn and a flange portion of a backing block, having piezoelectric elements disposed therebetween and fastened together by a plurality of bolts, to a seat portion provided on the outer wall of a carburetor body through means of an annular supporting plate, a holding plate, fitted to said annular supporting plate, being secured to said outer wall by a plurality of screws; and said piezoelectric elements are connected to said ultrasonic wave oscillator and an energy source by lead wires.

39. An ultrasonic wave carburetor according to claim 26, wherein:

said hollow cylinder is aligned with said intake passage through means of an annular ring, by securing a supporting plate, secured at the position of a vibrational node of said conical type horn, to a projecting seat, provided on a wall forming an atomizing chamber, by a plurality of screws and through means of an annular spacer.

40. An ultrasonic wave carburetor according to claim 28, wherein:

said hollow cylinder is aligned with said intake passage, formed by said annular member, through means of an annular ring interposed within a stepped portion of said annular member, by securing a supporting plate, secured at the position of a vibrational node of said conical type horn, to a projecting seat provided on a wall forming an atomizing chamber, by a plurality of screws and through means of an annular spacer.

41. An ultrasonic wave carburetor according to claim 30, wherein:

said hollow cylinder is aligned with said intake passage, formed by said bent annular member, through means of an annular ring interposed within a stepped portion of said bent annular member, by securing a supporting plate, secured at the position of a vibrational node of said conical type horn, to a projecting seat provided on a wall forming an atomizing chamber, by a plurality of screws and through means of an annular spacer.

* * * * *